US006904778B2

(12) United States Patent
Jasper

(10) Patent No.: US 6,904,778 B2
(45) Date of Patent: Jun. 14, 2005

(54) MECHANICAL COMBINATION LOCK

(75) Inventor: Thomas Jasper, Bryantsville, KY (US)

(73) Assignee: Lockmasters, Inc., Nicholasville, KY (US)

( * ) Notice: Subject to any disclaimer, the term of this patent is extended or adjusted under 35 U.S.C. 154(b) by 0 days.

(21) Appl. No.: 10/424,885

(22) Filed: Apr. 28, 2003

(65) Prior Publication Data

US 2004/0211233 A1 Oct. 28, 2004

(51) Int. Cl.[7] ..... E05B 37/00
(52) U.S. Cl. ..... 70/314; 70/303 A; 70/333 R
(58) Field of Search ..... 70/1.5, 1.7, 314–322, 70/303 A, 303 R, 333 R, 312

(56) References Cited

U.S. PATENT DOCUMENTS

| | | | |
|---|---|---|---|
| 44,207 A | 9/1864 | Marvin | |
| 600,900 A | 3/1898 | Taylor | |
| 1,803,531 A | 5/1931 | Kromer | |
| 1,847,071 A | 3/1932 | Doenges | |
| 1,848,997 A | 3/1932 | Doenges | |
| 1,925,980 A | 9/1933 | Doenges | 70/53 |

(Continued)

*Primary Examiner*—Suzanne Dino Barrett
(74) *Attorney, Agent, or Firm*—Wood, Herron & Evans, L.L.P.

(57) ABSTRACT

A combination lock configured to resist surreptitious compromise by radiographic imaging and automatic dialers. In one aspect, the combination lock may include gate wheels having one true gate positioned among a plurality of false gates in which the true gate is configured for disguising its angular position among the false gates. Additional resistance against radiation imaging is provided by the rotational symmetry of the features of the gate wheels. The combination lock may include a combination scrambler that rotates a gate wheel when an incorrect combination is dialed for defeating the operation of automatic dialers. The combination lock may also include a combination change key and the gate wheels may be configured to be selectively disengaged from the combination dial by the combination change key so that the lock combination may be modified.

44 Claims, 19 Drawing Sheets

U.S. PATENT DOCUMENTS

| | | | | |
|---|---|---|---|---|
| 1,928,853 | A | | 10/1933 | Doenges ..... 70/53 |
| 2,016,487 | A | | 10/1935 | Doenges ..... 70/53 |
| 2,123,270 | A | | 7/1938 | Bell ..... 70/314 |
| 2,672,042 | A | | 3/1954 | George ..... 70/303 |
| 2,856,765 | A | | 10/1958 | Sreb ..... 70/333 |
| 2,900,813 | A | | 8/1959 | Miller ..... 70/333 |
| 2,938,374 | A | | 5/1960 | Criscuolo et al. ..... 70/333 |
| 2,970,217 | A | | 1/1961 | Enikeieff ..... 250/108 |
| 3,024,640 | A | | 3/1962 | Miller ..... 70/332 |
| 3,098,376 | A | | 7/1963 | Miller ..... 70/333 |
| 3,237,435 | A | | 3/1966 | Paul ..... 70/323 |
| 3,254,519 | A | | 6/1966 | Paul ..... 70/323 |
| 3,339,382 | A | | 9/1967 | Miller et al. ..... 70/23 |
| 3,339,383 | A | | 9/1967 | Miller et al. ..... 70/333 |
| 3,386,275 | A | | 6/1968 | Potzick ..... 70/316 |
| 3,436,941 | A | | 4/1969 | Potzick ..... 70/311 |
| 3,447,348 | A | | 6/1969 | Dauenbaugh ..... 70/285 |
| 3,473,354 | A | | 10/1969 | Hutchins ..... 70/312 |
| 3,481,167 | A | | 12/1969 | Barner ..... 70/314 |
| 3,518,856 | A | | 7/1970 | Potzick ..... 70/299 |
| 3,719,064 | A | | 3/1973 | Potzick ..... 70/299 |
| 3,747,377 | A | | 7/1973 | Van Deudekom ..... 70/149 |
| 3,786,658 | A | | 1/1974 | Swaim ..... 70/333 |
| 3,800,577 | A | | 4/1974 | Norremark ..... 70/313 |
| 3,906,761 | A | | 9/1975 | Swaim ..... 70/333 |
| 3,968,667 | A | | 7/1976 | Gartner et al. ..... 70/303 |
| 3,983,727 | A | | 10/1976 | Todd ..... 70/323 |
| 3,991,596 | A | * | 11/1976 | Gartner ..... 70/303 A |
| 4,040,280 | A | | 8/1977 | Main et al. ..... 70/333 |
| 4,106,316 | A | | 8/1978 | Tippin ..... 70/268 |
| 4,147,045 | A | | 4/1979 | Testa ..... 70/314 |
| 4,238,942 | A | | 12/1980 | Parrock, Sr. ..... 70/299 |
| 4,312,199 | A | | 1/1982 | Uyeda ..... 70/316 |
| 4,328,689 | A | | 5/1982 | Keller et al. ..... 70/303 |
| 4,420,955 | A | * | 12/1983 | Marold ..... 70/303 A |
| 4,693,100 | A | | 9/1987 | Wetz, Jr. ..... 70/333 |
| 4,708,006 | A | | 11/1987 | Hodgson ..... 70/303 |
| 4,722,207 | A | | 2/1988 | Wertz, Jr. ..... 70/303 |
| 4,776,190 | A | | 10/1988 | Miller et al. ..... 70/303 |
| 4,796,446 | A | | 1/1989 | Miller et al. ..... 70/316 |
| 4,803,859 | A | | 2/1989 | Miller et al. ..... 70/323 |
| 4,895,010 | A | | 1/1990 | Legault ..... 70/314 |
| 4,901,546 | A | | 2/1990 | Uyeda et al. ..... 70/323 |
| 4,910,981 | A | | 3/1990 | Gartner ..... 70/314 |
| 4,961,332 | A | | 10/1990 | Deswarte et al. ..... 70/303 |
| 5,095,724 | A | | 3/1992 | Lainhart ..... 70/303 |
| 5,343,723 | A | | 9/1994 | Miller et al. ..... 70/303 |
| 5,473,920 | A | * | 12/1995 | Goldman ..... 70/303 A |
| 5,592,838 | A | | 1/1997 | Clark et al. ..... 70/303 |
| 5,749,252 | A | | 5/1998 | Rhoades ..... 70/276 |

* cited by examiner

MECHANICAL COMBINATION LOCK

FIELD OF THE INVENTION

The invention relates to combination locks and, in particular, to combination locks that resist surreptitious compromise by radiographic imaging or automatic dialers and that accommodate combination changes while retaining the resistance against surreptitious compromise.

BACKGROUND OF THE INVENTION

Combination locks are used to secure lockable, high-security enclosures, such as vaults, safes, and cabinets, that afford controlled access to stored items. Mechanical combination locks rely on the rotation of an external dial to manipulate various mechanical elements housed inside a lock casing to register gates in rotatable tumbler wheels or gate wheels with at least one fence carried by a movable fence bar. When the tumbler wheel gates and fences are registered by the entry of a proper combination, the dial may be used to retract a lock bar or dead bolt so that the enclosure can be opened and accessed.

Mechanical combination locks are susceptible to illicit or surreptitious attack by operation of an automatic dialer. The automatic dialer, which is coupled with the lock's dial, systematically dials different combinations of the mechanical combination lock. If a particular combination fails, the automatic dialer proceeds to dial other successive combinations in an attempt to unlock the lock. For example, for a three-tumbler combination lock, the automatic dialer parks one gate wheel at a specific combination number, dials all possible pairs of combination numbers for the other two gate wheels and attempts to retract the dead bolt at each dialed pair, increments the combination number of the first gate wheel, and repeats this process until the proper combination is discovered. Given sufficient time to perform the trial-and-error manipulation, the automatic dialer is particularly effective in compromising the access control afforded by a mechanical combination lock.

Conventional combination scrambler mechanisms have been developed for use in mechanical combination locks that rotate one of the gate wheels as an automatic dialer attempts to systematically dial all possible combinations and to retract the lock bolt at each dialed combination. The rotation of the gate wheel prevents the automatic dialer from parking the gate wheel at a fixed angular location and relying upon that angular location as a reference point. However, conventional combination scrambler mechanisms increment the angular orientation of the gate wheel by an equal angular increment each time that an attempt is made to retract the lock bolt. Because the angular increment is constant and predictable, sophisticated automatic dialers can compensate for changes in the parked angular position of the gate wheel imparted by the combination scrambler by a simple correction factor consisting of the number of attempts multiplied by the constant angular increment.

Mechanical combination locks are also susceptible to surreptitious attack by radiographic imaging methods. Penetrating radiation, such as x-rays and neutrons, can be used to image the internal elements, such as the tumbler wheels and tumbler wheel gates, inside the lock case otherwise hidden from view. As a result, the angular locations of the internal elements, such as the gates, of conventional mechanical combination locks may be observed by radiographic imaging.

The tumbler wheels of mechanical combination locks may be designed to resist radiological detection by, for example, disguising one true gate among multiple false gates each having a similar construction to the true gate. However, conventional false gates are incapable of providing adequate protection or add significantly to the cost of manufacture. In addition, other internal elements, such as fixed-position features on a tumbler wheel or a combination change mechanism, of the mechanical combination lock have a fixed angular position relative to one or more of the gates. The internal elements may be used as fixed reference points or features for determining the angular location of the true gate despite the presence of multiple false gates. As a result, the presence of false gates alone frequently cannot defeat the use of radiographic imaging for determining the angular locations of lock internal elements, such as tumbler wheel gates.

Accordingly, there is a need for combination locks having an increased level of security, while at the same time overcoming many of the shortcomings of conventional mechanical combination locks.

SUMMARY OF THE INVENTION

The present invention provides apparatus and methods that increase the level of security afforded by a mechanical combination lock. A combination lock in accordance with the principles of the present invention is provided with a rotatable first gate wheel having a first gate, a rotatable second gate wheel having a second gate, at least one fence capable of being engaged with the first and the second gates, and a combination entry device capable of rotating the first and the second gate wheels for varying an angular alignment between a corresponding one of the first and second gates and the one fence. When a proper combination is entered, the first and second gates are aligned angularly with the fence. If one of a plurality of improper combinations is entered, at least one of the first and the second gates is non-aligned angularly with the fence. The combination lock includes a lock bolt actuatable between a locked position and an unlocked position and a lock-bolt drive mechanism capable of actuating the lock bolt from the locked position to the unlocked position, after the proper combination is entered, and capable of attempting to actuate the lock bolt from the locked position to the unlocked position, after one of the plurality of improper combinations is entered. The combination lock further includes a combination scrambler configured to rotate the first gate wheel by first and second different angles if the lock-bolt drive mechanism attempts to move the lock bolt from the locked position to the unlocked position after entry of successive improper combinations.

The combination scrambler of the invention increases the resistance of the combination lock to unauthorized opening by an attempt to sequentially enter all possible lock combinations, for example, by operation of an automatic dialer. Specifically, the combination scrambler prevents at least one of the gate wheels from being parked with a predictable angular orientation while the other gate wheels are dialed to enter serial combinations and an attempt is made at each dialed combination to open the combination lock. To that end, the combination scrambler moves the associated gate wheel by unequal angular increments as possible combinations are successively or consecutively dialed on the other gate wheels and an attempt is made to open the lock at each successive or consecutive combination. As a result, the automatic dialer cannot rely on predictability in the angular location of the scrambled gate wheel or gate wheels acted upon by the combination scrambler and cannot otherwise sense the operation of the combination scrambler. In other words, the automatic dialer loses track of the angular position of the scrambled gate wheel as the other gate wheels are serially rotated and, thereafter, cannot systematically increment the angular position of the scrambled gate wheel. The operation of the combination scrambler significantly lengthens the time required for an automatic dialer to compromise the combination lock.

In accordance with one aspect of the invention, a combination lock comprises a fence, a combination entry device, a drive hub operatively coupled with the combination entry device, a rotatable gate wheel assembly having a gate wheel with a gate configured to be engageable with the fence, a lock bolt movable between locked and unlocked positions, and a lock-bolt drive mechanism configured for moving the lock bolt from the locked position to the unlocked condition when the gate is aligned angularly with the fence by operation of the combination entry device. The gate wheel assembly includes a first outer wheel and a second outer wheel in which the gate wheel is positioned between the first and the second outer wheels. The gate wheel assembly is rotatable in response to operation of the combination entry device for changing the relative angular alignment between the gate and the fence. The first and the second outer wheels have a coupled condition in which the gate wheel assembly is coupled for rotation with the drive hub, and an uncoupled condition in which the gate wheel assembly is uncoupled from, and rotatable independently of, the drive hub. The combination lock further includes a combination change key or mechanism operative for selectively manipulating the first and the second outer wheels to provide the coupled and uncoupled conditions.

The combination change mechanism of the invention may be constructed such that it lacks any feature, such as an opening or a rivet, that would be visible in a radiographic image of the combination lock. As a result, no feature of the combination change mechanism bears a predictable relationship relative to the gate of the combination lock in the radiographic image. Similarly, the gate wheels are free of features that would be visible and recognizable in a radiographic image of the combination lock.

In accordance with another aspect of the invention, a combination lock comprises a fence and a rotatable gate wheel operatively coupled with the combination entry device. The gate wheel includes an outer rim, an axis of rotation, a first projection extending radially outward from the outer rim, and a plurality of second projections extending radially outward from the outer rim. The first and the second projections are circumferentially arranged with a spaced relationship about the outer rim. The first projection has a different shape than the second projections, in which the first projection has a triangular or irregular cross-sectional profile in a radial direction relative to an axial centerline of the gate wheel. The first projection and an adjacent one of the second projections define a first recess shaped to permit engagement by the fence. A plurality of second recesses are defined between adjacent pairs of second projections.

The combination lock further includes a combination entry device capable of rotating the gate wheel about the axis of rotation for changing the relative angular alignment between the first recess and the fence, a lock bolt movable between locked and unlocked positions, and a lock-bolt drive mechanism configured for moving the lock bolt from the locked position to the unlocked condition when the first recess is aligned with the fence.

According to the principles of this aspect of the invention, the true gate has an appearance in a radiographic image that is substantially indistinguishable from the multiple false gates of the mechanical combination lock. According to the principles of the invention, the projections defining the false and true gates provide imaged features that cannot be distinguished from one another. As a result, radiographic imaging cannot be relied upon for determining the angular location of the true gate on the gate wheel.

These and other advantages, objectives and features of the invention will become more readily apparent to those of ordinary skill upon review of the following detailed description of an illustrative embodiment of the invention.

DETAILED DESCRIPTION OF THE PREFERRED EMBODIMENT

Figure 1:
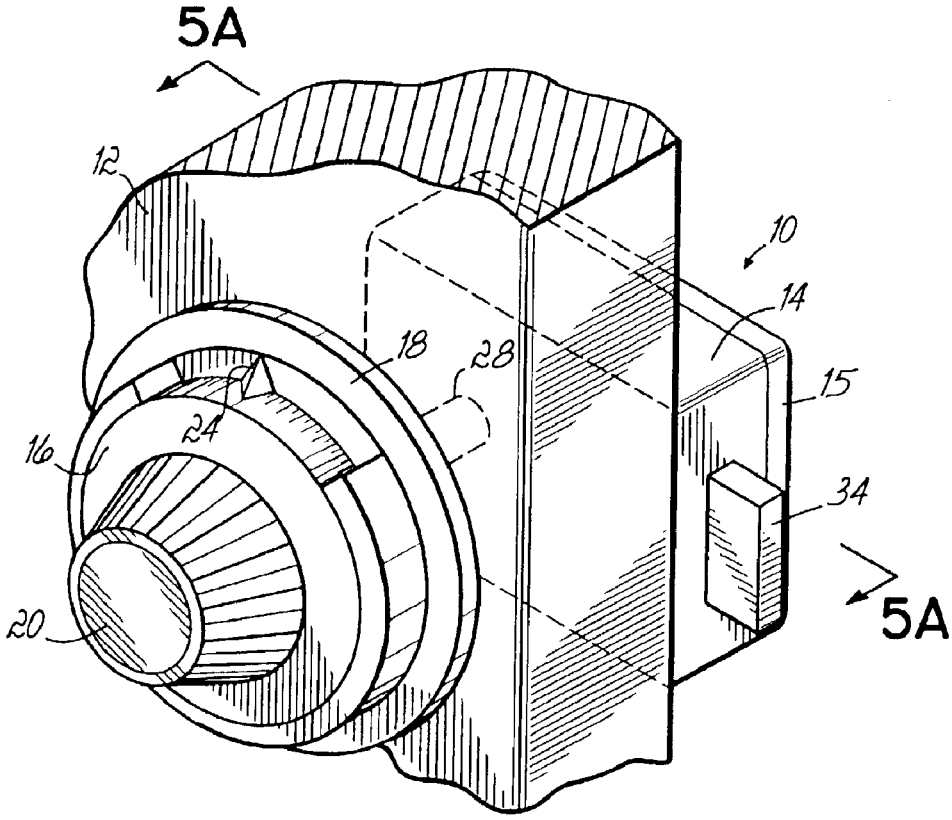
FIG. 1 is a perspective view of a combination lock constructed according to the principles of the invention.

With reference to FIG. 1, a combination lock 10 of the invention is mounted on a supporting door 12 of a safe, vault, cabinet or other high security enclosure. The combination lock 10 includes a substantially rectangular lock case 14 configured to be mounted using conventional fasteners against an inner surface of door 12. A detachable rear closure or cover 15 closes the rear of the lock case 14 and operates for supporting various components of the combination lock 10.

Secured to an outer surface of the supporting door 12 is a combination entry device in the form of a dial 16 having an outer periphery shrouded by a shield 18 and a knob 20 used to manually manipulate the dial 16. Arranged with equal angular intervals about the outer periphery of the dial 16 is a plurality of, for example, one hundred markings. The periphery of shield 18 conceals the markings from view other than markings located within a circumferential sight opening 22. An indicator 24 of shield 18 overhangs a small portion of the outer periphery of the dial 16 and includes a stationary index mark for indicating the current marking value as dial 16 is rotated.

Dial 16 is coupled with a spindle 28 extending rearwardly through the thickness of the supporting door 12 and into the lock case 14. The spindle 28 is journalled for free rotation within a tubular tumbler post 30, as best visible in FIGS. 6 and 7, projecting inwardly from a front wall 32 of the lock case 14. The spindle 28 is also supported by the tumbler post 30 for axial movement relative to the tumbler post 30 over a limited linear displacement distance. The dial 16 and spindle 28 are biased outwardly from the lock case 14 by a biasing element (not shown).

Figure 2:
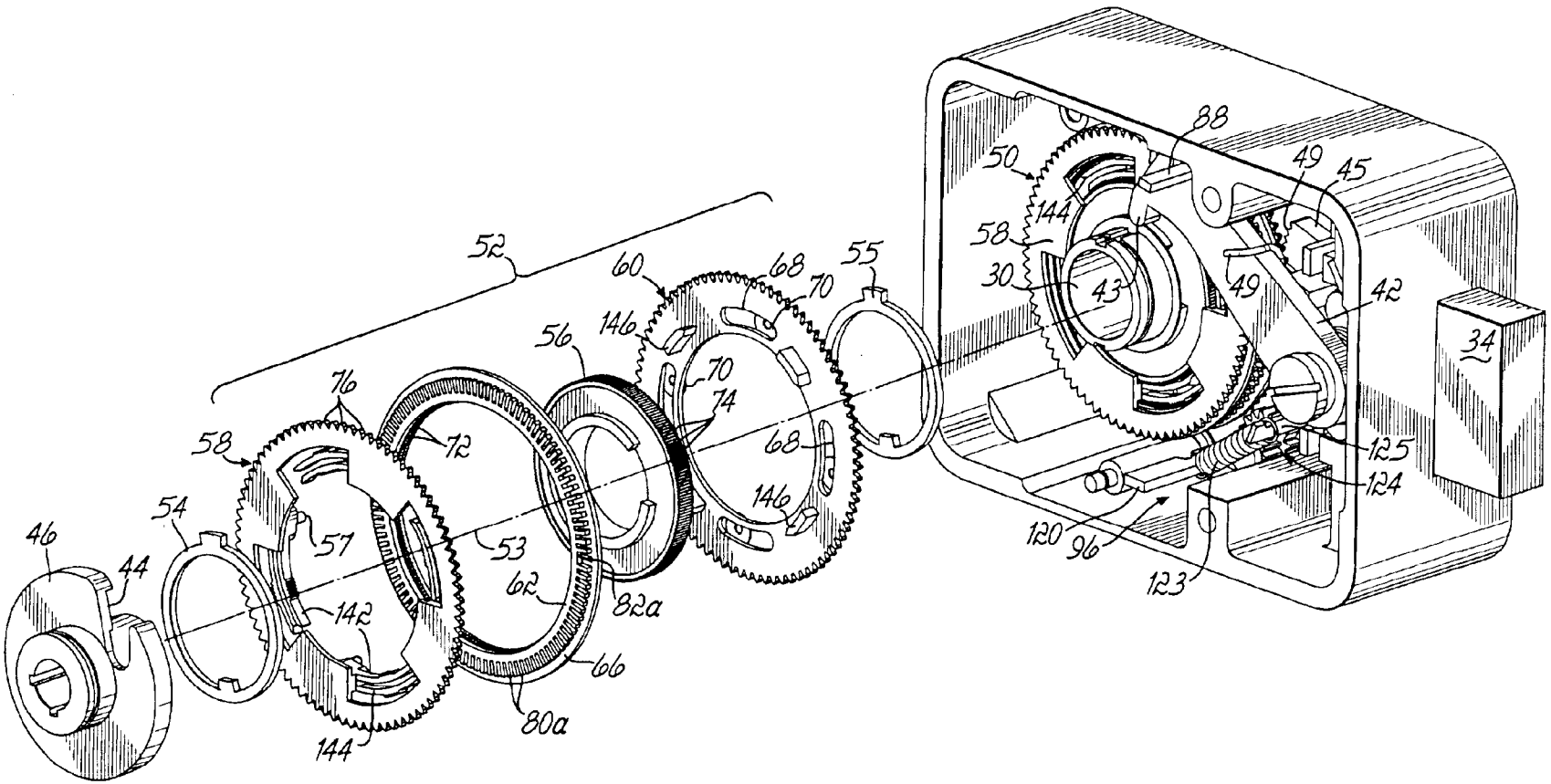
FIG. 2 is a perspective view of the interior of the lock case of the combination lock of FIG. 1 in which one of the tumbler wheel assemblies is exploded.
Figure 5A:
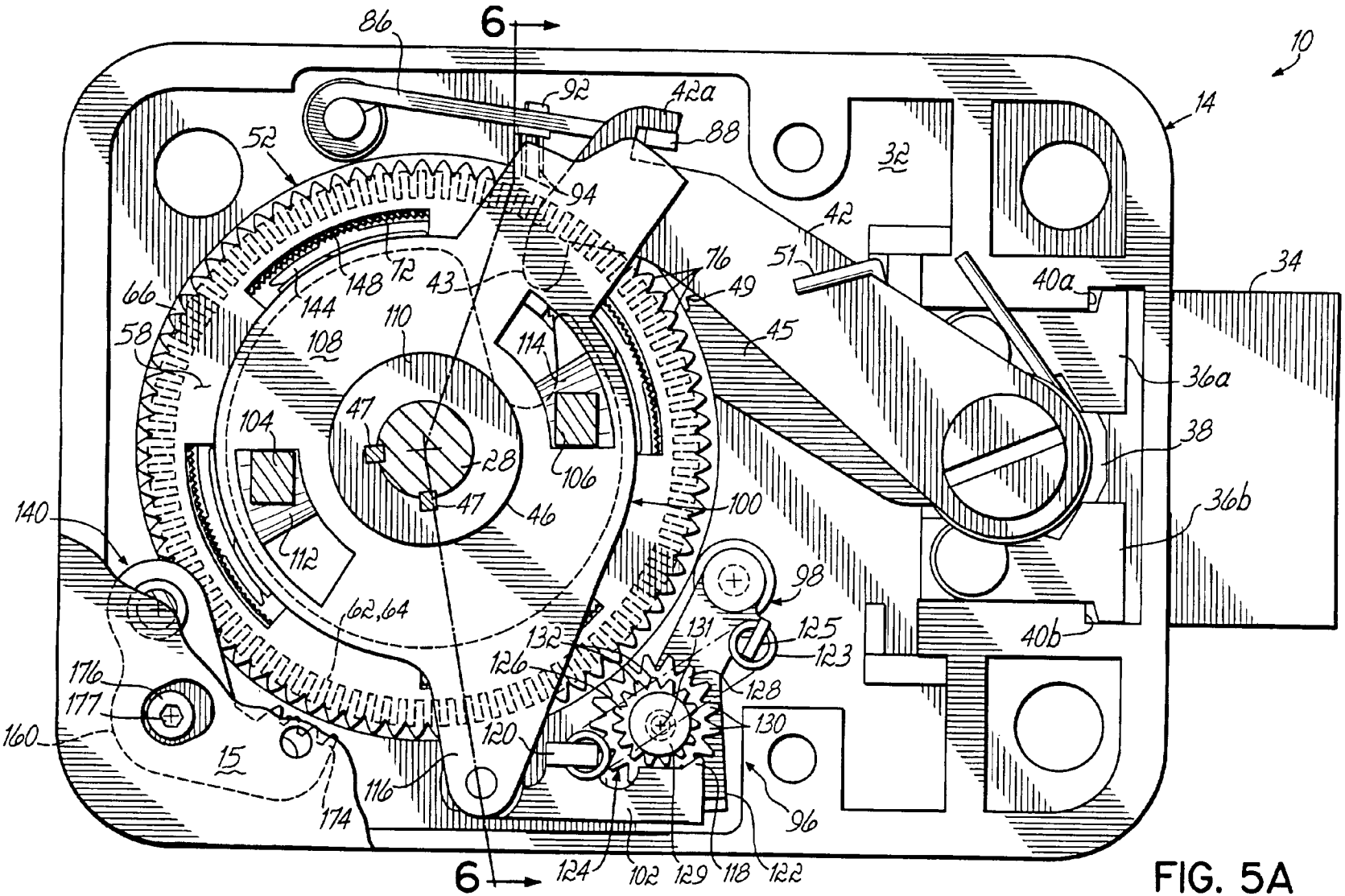
FIGS. 5A is a rear elevation view with the rear cover removed taken generally along line 5A—5A in FIG. 1.

With reference to FIGS. 2 and 5A, a lock bolt 34 projects outwardly through an opening provided in a side edge of lock case 14. The lock bolt 34 is movable or actuatable in a suitable guideway provided in the lock case 14 between a locked position (FIG. 5A), in which an exposed length of the lock bolt 34 is extended from the lock case 14, and an unlocked position (FIG. 5F), in which the lock bolt 34 is retracted to be positioned substantially within lock case 14. A pair of pivotal locking pawls 36*a*, 36*b* are configured for engaging respective stop surfaces 40*a*, 40*b*, when the lock bolt 34 is in the locked position, so as to resist an inwardly-directed tampering force applied to the protruding free end of the lock bolt 34. The locking pawls 36*a*, 36*b* are pivoted by a sliding release mechanism 38 to disengage the stop surfaces 40*a*, 40*b* when a correct combination is dialed to free the lock bolt 34 for retraction into lock case 14.

Manual manipulation of the dial 16 operates a lock-bolt drive mechanism capable of moving the lock bolt 34 between its locked position and unlocked positions if a proper combination is entered. The lock-bolt drive mechanism includes spindle 28, a drive cam 46 and a bolt lever 42. One end of the bolt lever 42 is pivotally attached to the lock bolt 34. An opposite end of the bolt lever 42 includes a lever nose 43 that is selectively engageable with a notch 44 in a drive cam 46 by lowering when a proper combination is entered. Entry of a proper combination angularly aligns the notch 44 with the lever nose 43. The bolt lever 42 is raised from the drive cam 46 so that, unless a proper combination is entered, the lever nose 43 is normally disengaged or otherwise uncoupled from the notch 44 in the drive cam 46. A biasing element or spring 51 biases the bolt lever 42 in a direction for moving the lever nose 43 toward the notch 44.

The drive cam 46 and spindle 28 are coupled together for concurrent rotation by a pair of spline keys 47, as best visible in FIG. 5A, inserted into corresponding registered pairs of splines in the spindle 28 and spline ways in the drive cam 46. Rotation of the spindle 28 and drive cam 46, with the lever nose 43 and notch 44 coupled, operates to retract the lock bolt 34 from its locked position to its unlocked position only if a proper or correct combination is entered. Following entry of an improper or incorrect combination, the lever nose 43 and notch 44 are not aligned and cannot be coupled when the bolt lever 42 is lowered, so that rotation of the spindle 28 and drive cam 46 is futile and results in an unsuccessful attempt to retract the lock bolt 34 from its locked position to its unlocked position.

With reference to FIGS. 2, 2A, 3 and 4, housed within the lock case 14 is a wheel pack consisting of a front tumbler wheel assembly 48, a middle tumbler wheel assembly 50, and a rear tumbler wheel assembly 52 that are each rotatably journalled about the outer circumference of the tumbler post 30. The three tumbler wheel assemblies 48, 50 and 52 have a coaxial, juxtaposed spaced relationship and are independently rotatable about an axis of rotation 53 when the dial 16 is manipulated to enter a combination. Each number of the proper three-number combination is associated with a corresponding one of the three tumbler wheel assemblies 48, 50 and 52.

Projecting away from the drive cam 46 is a pair of drive pins or fly stops (not shown) that cooperate with a fly 54 to supply a lost motion connection with a drive hub 56 mechanically coupled with the rear tumbler wheel assembly 52. The fly 54 includes projections that engage corresponding ones of the fly stops on the drive cam 46. A similar lost motion connection is provided by respective flies, such as fly 54, between the drive hub 56 of each of the other tumbler wheel assemblies 48, 50 to provide driven rotation as the drive cam 46 is rotated by revolution of spindle 28. The lost motion connections permit each of the tumbler wheel assemblies 48, 50, 52 to be individually picked up for rotation as a combination is entered using dial 16 and to be individually parked at a specific angular orientation so that another of the tumbler wheel assemblies 48, 50, 52 may be rotated without changing the angular orientation of the parked ones of the tumbler wheel assemblies 48, 50, 52.

Located between the front tumbler wheel assembly 48 and the front wall 32 of lock case 14 is a drive cam 41 having a number of serrations or teeth 41*a*. A travel arm 45 is movable for causing a number of serrations or teeth 49 on one end of travel arm 45 to become engaged with the teeth 41*a* of the drive cam 41 when the dial 16 is manipulated to return the lock bolt 34 from the unlocked position to the locked position. An opposite end of the travel arm 45 is pivotally coupled with the sliding release mechanism 38. Movement of the travel arm 45 moves the sliding release mechanism 38, when teeth 49 are engaged with teeth 41*a* and the drive cam 41 is revolved by manipulation of dial 16 and rotation of spindle 28, to cause the lock bolt 34 to extend from the unlocked position to the locked position.

The travel arm 45 and drive cam 41 constitute components of the lock-bolt drive mechanism. The drive cam 46, which operates to retract lock bolt 34 from the locked position to the unlocked position, does not operate to extend the lock bolt 34 from the unlocked position to the locked position. Instead, the travel arm 45 and drive cam 41 cooperate to transfer motion from the spindle 28 to the lock bolt 34 for extending the lock bolt 34. The cooperation of the drive cam 41 and travel arm 45 require manipulation of the dial 16, such as by reentering the proper lock combination, to move each of the tumbler wheels 48, 50, 52 out of position relative to the fences 90, 91, 92, while the lock bolt 34 is retracted, before the lock bolt 34 is extendible by operation of the drive cam 41 and travel arm 45 to relock combination lock 10. A similar mechanism for extending a lock bolt from an unlocked position to a locked position is described in U.S. Pat. No. 5,343,723, the disclosure of which is incorporated by reference herein in its entirety.

Because the tumbler wheel assemblies 48, 50 and 52 are constructed in a substantially identical manner, the following discussion of rear tumbler wheel assembly 52 is equally applicable to tumbler wheel assemblies 48 and 50. It is contemplated by the invention that, although three individual wheel assemblies 48, 50, 52 are shown in this embodiment of the invention, two or more individual wheel assemblies may cooperate to form a wheel pack for use with combination lock 10.

Figure 2A:
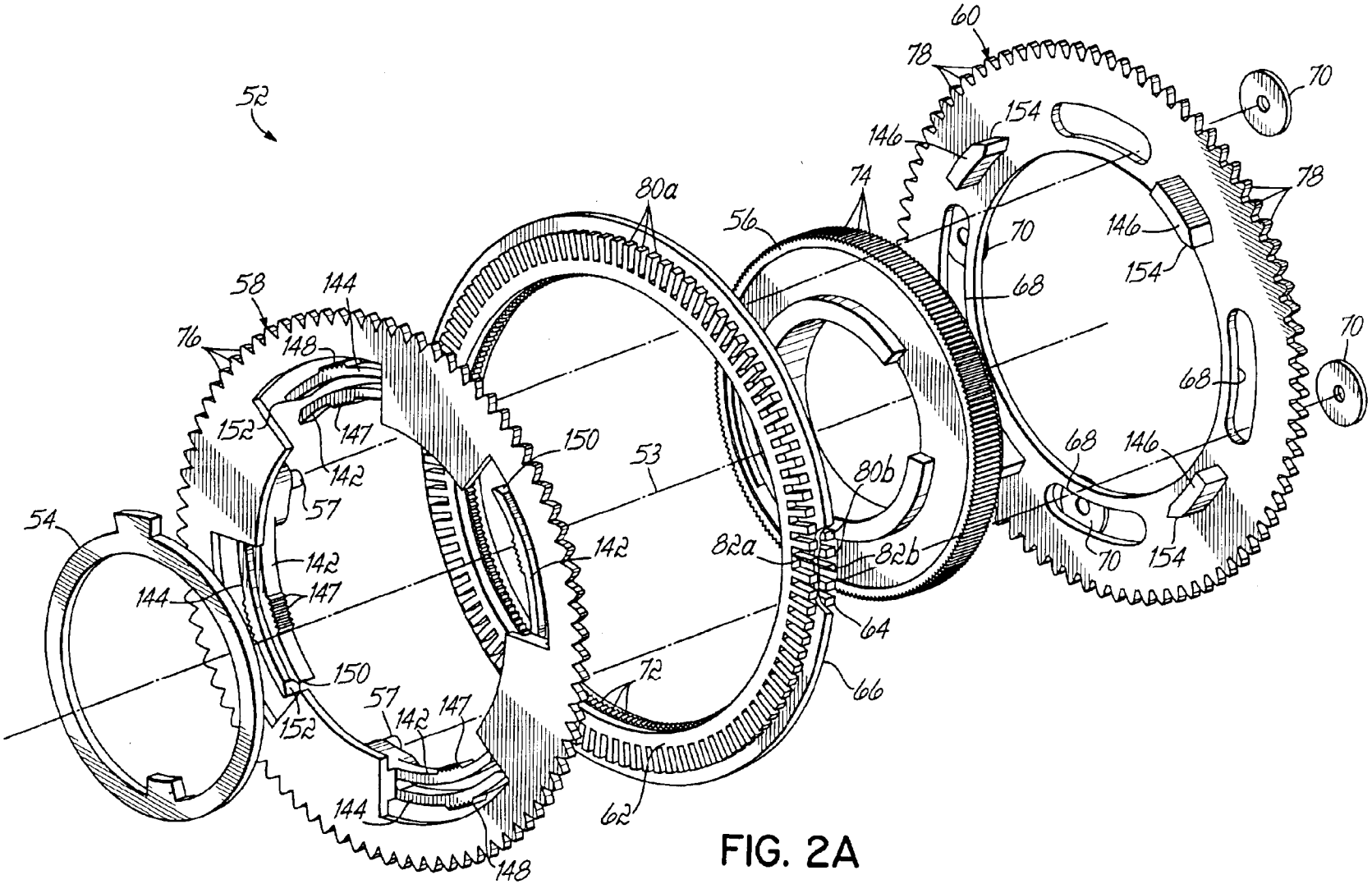
FIG. 2A is an exploded perspective view of one of the tumbler wheel assemblies of FIG. 2.
Figure 3:
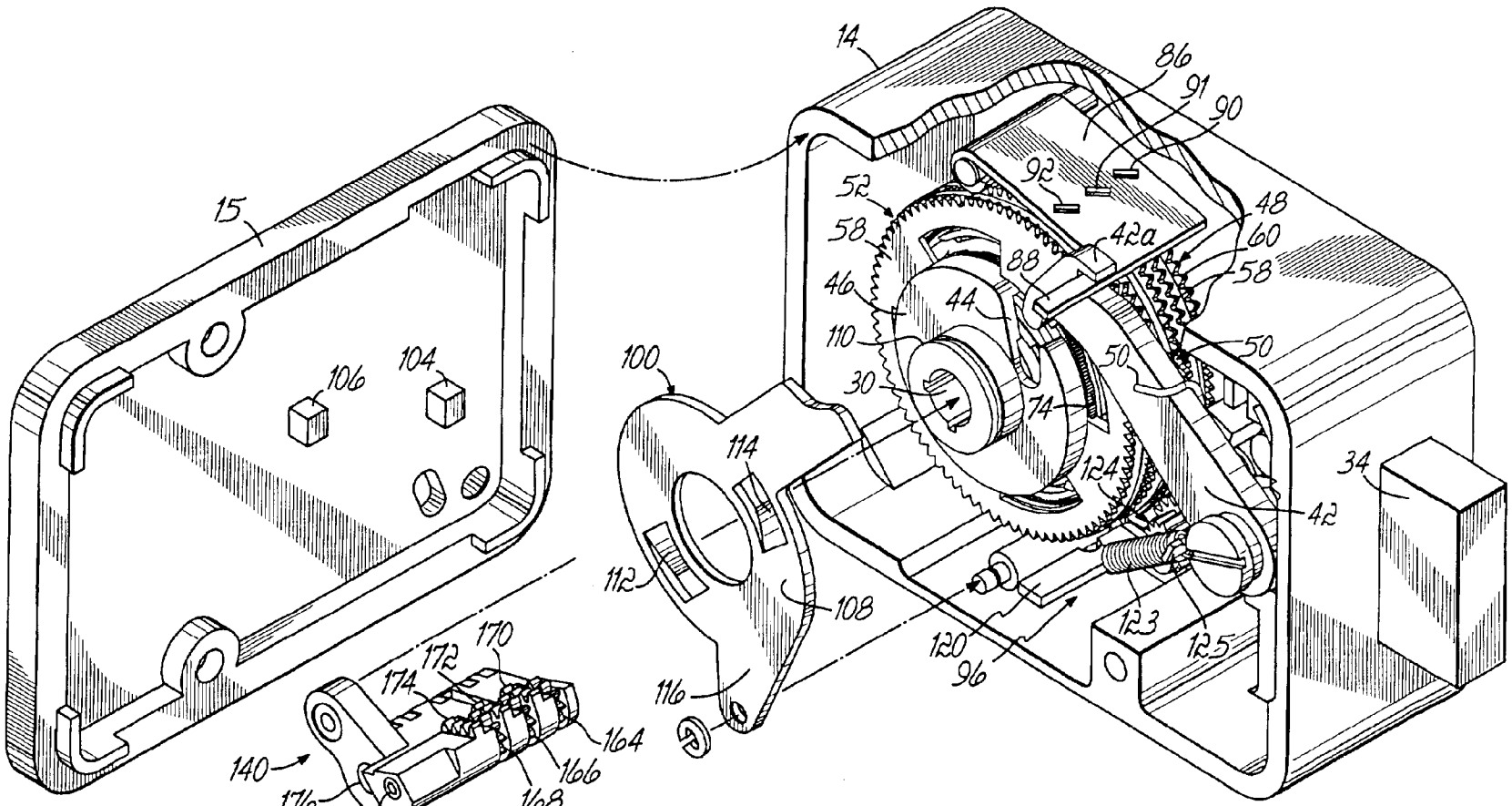
FIG. 3 is an exploded rear perspective view of the combination lock of FIG. 1 in which the rear cover is removed.

With specific reference to FIGS. 2 and 2A, rear tumbler wheel assembly 52 includes a pair of generally annular outer wheels 58, 60, a pair of generally annular gate wheels 62, 64 positioned between the outer wheels 58, 60, and a generally annular coupling or middle wheel 66 positioned between the gate wheels 62, 64. The rear tumbler wheel assembly 52 is staked or pin riveted together by deforming or upsetting the free end of each of a plurality of tabs or pins 57 (FIG. 2A) projecting from outer wheel 58 that protrude through individual arcuate slots 68 provided in outer wheel 60 so as to capture a corresponding one of a plurality of fastening elements 70. The arcuate slots 68 permit the outer wheels 58, 60 to be relatively rotatable, as described herein, while maintaining their staked or pin riveted mutual attachment for securing the various components of the rear tumbler wheel assembly 52 together. The two gate wheels 62, 64 and middle wheel 66 are united as an assembly and rotate collectively as an assembly about axis 53.

An inner peripheral rim of the middle wheel 66 includes a plurality of teeth 72 and an outer peripheral rim of drive hub 56 includes a plurality of teeth 74 that are spaced radially from teeth 72. Drive hub 56 is disposed inside the inner diameter of middle wheel 66 and operates to transfer rotation from the spindle 28 and drive cam 46 to the rear tumbler wheel assembly 52, as described herein. A central opening of the drive hub 56 is rotatably coupled with the tumbler post 30. Arranged with equal angular spacings about the outer peripheral rim of outer wheel 58 is a plurality of triangular teeth 76 and, similarly, arranged with equal angular spacings about the outer peripheral rim of outer wheel 60 is a plurality of triangular teeth 78. Triangular teeth 76 and 78 permit the scrambler mechanism 96 and combination change key 140, each described herein, to interact with or otherwise operate upon the outer wheels 58, 60.

Figure 4A:
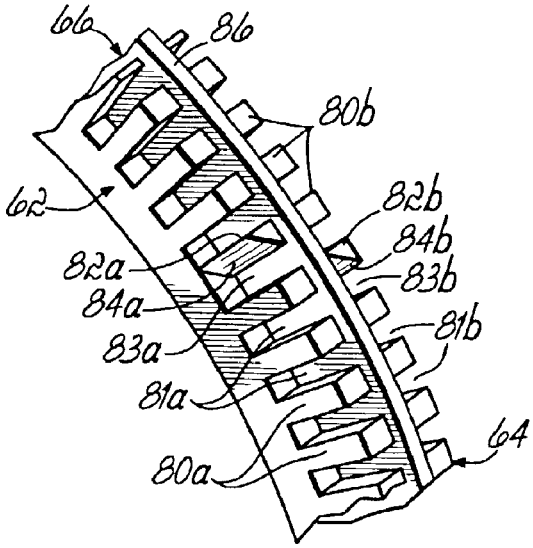
FIG. 4A is an enlarged perspective view partially broken away of FIG. 4.
Figure 4:
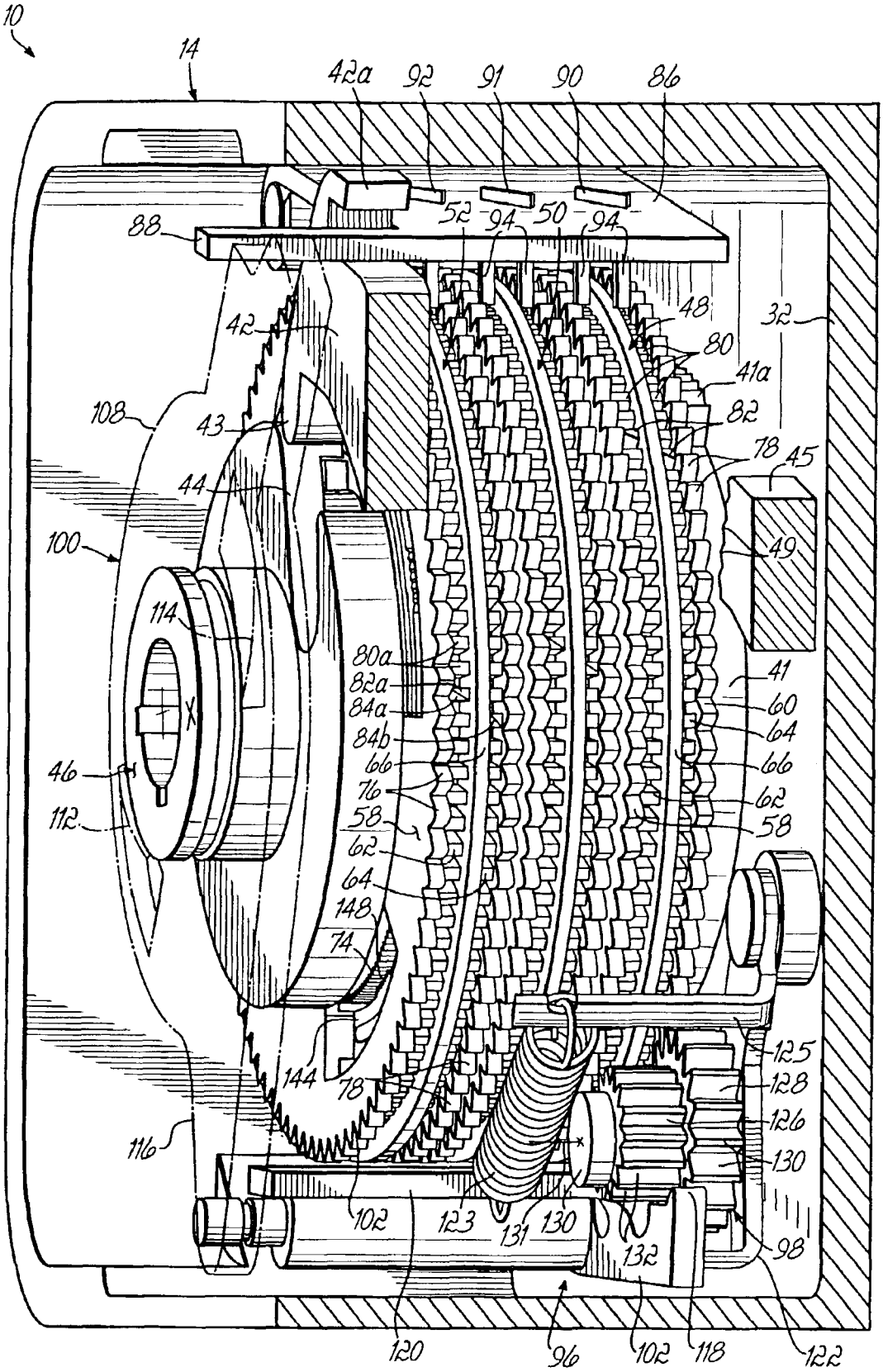
FIG. 4 is a partial cross-section view taken generally along line 4—4 of FIG. 3.

With reference to FIGS. 2A, 4 and 4A, disposed with uniform angular spacing about the rim of gate wheel 62 is a plurality of projections 80*a* having a radially-measured cross-sectional profile and a single projection 82*a* having a different radially-measured cross-sectional profile. Similarly, a plurality of projections 80*b* having a radially-measured cross-sectional profile and a single projection 82*b* having a different radially-measured cross-sectional profile are disposed with uniform angular spacing about the rim of gate wheel 64. Each of the projections 80*a,b* and 82*a,b* extend radially outward from the rim from the corresponding one of the gate wheels 62, 64. Projections 80*a,b* may have a generally trapezoidal cross-sectional profile viewed in a radial direction relative to common axis 53 (FIGS. 2 and 3), which is aligned with the centers of gate wheels 62, 64. Generally, projections 82*a,b* have a non-trapezoidal cross-sectional profile viewed radially relative to axis 53. In a preferred embodiment, projections 82*a,b* have a generally triangular cross-sectional profile that includes a corresponding inclined surface 84*a,b*, which may be flat or planar. The cross-sectional profile of projections 82*a,b* may be right triangular in which a respective hypotenuse of each right triangle defines a corresponding one of the inclined surfaces 84*a,b*. The inclined surfaces 84*a,b* may extend, as shown, across the dimension of the projections 82*a,b* that is generally parallel to axis 53 or may only partially extend thereacross. In one specific embodiment of the invention, the inclined surfaces 84*a,b* are each angled at about 36°. Gate wheels 62, 64 are angularly aligned about axis 53 relative to one another so that the inclined surfaces 84*a,b* lie substantially in a common plane and, typically, inclined surfaces 84*a,b* are coplanar to within about ±0.25°.

The gaps or recesses 81*a* between adjacent pairs of projections 80*a* and the recesses 81*b* between adjacent pairs of projections 80*b* define corresponding sets of false gates on the corresponding one of gate wheels 62, 64. Typically, the number of false gates on each of the gate wheels 62, 64 is at least ninety-nine. The gap or recess 83*a* between projection 82*a* and the one of projections 80*a* adjacent to inclined surface 84*a* defines a portion of a true gate on gate wheel 62. Similarly, the gap or recess 83*b* between projection 82*b* and the one of projections 80*b* adjacent to inclined surface 84*b* defines another portion of a true gate on gate wheel 64. The false and true gates each correspond in angular position with a corresponding marking provided on the outer periphery of dial 16. The marking on dial 16 corresponding to the true gate provides one number in the proper combination for combination lock 10.

With reference to FIGS. 3, 4, 6 and 7, pivotally coupled with the lock case 14 is a fence bar 86 having a plurality of, for example, three fences 90, 91, 92 each associated with a corresponding one of the tumbler wheel assemblies 48, 50, 52. Extending from the fence bar 86 toward the rear cover 15 is a flange 88 that is coupled with a corresponding flange 42*a* of the lever arm 42 so that the movements of the fence bar 86 and lever arm 42 are correlated as the dial 16 is manipulated to enter a combination and to attempt to unlock the combination lock 10. Each of the fences 90, 91, 92, for example, fence 90 consists of a pair of axially-spaced prongs 94 overhanging the outer periphery and the gates, defined by recesses 81*a,b* and 83*a,b*, of the respective gate wheels 62, 64 of front tumbler wheel assembly 48. Similarly, fence 91 has prongs 94 that overhang the gates, defined by recesses 81*a,b* and 83*a,b*, of middle tumbler wheel assembly 50 and fence 92 has prongs 94 that overhand the gates, defined by recesses 81*a,b* and 83*a,b*, of rear tumbler wheel assembly 52. Each prong 94 is angled to permit the fences 90, 91, 92 to engage the recesses 83*a,b* on each of the gate wheels 62, 64. The pair of prongs 94 associated with each of the fences 90, 91, 92 have flat surfaces that are coplanar and that are angled to permit engagement with the respective recesses 83*a,b* but prohibit engagement with recesses 81*a,b*. The middle wheel 66 defines an alignment guide that steers the lowering of fence 82 for bringing the fences 90, 91, 92 into properly alignment with the recesses 83*a,b*.

The fence bar 86 will lower so that each of the prongs 94 fits into a corresponding one of the recesses 83*a,b* when a proper combination is entered to interrelate or register the angular orientation of the recesses 83*a,b* with the respective prongs 94 on fences 90, 91, 92, the drive cam 46 is oriented in angular position with the notch 44 confronting the lever nose 43, and the bolt lever 42 is capable of being lowered for engaging the lever nose 43 with the notch 44. It is contemplated by the invention that each of the fences 90, 91, 92 may include a single prong 94 and that each tumbler wheel assembly 48, 50, 52 may include only a single one of the two gate wheels 62, 64 having a single true gate and multiple false gates. It is also contemplated by the invention that the fences 90, 91, 92 of fence bar 86 may be constructed as a single fence, which may or may not include multiple prongs 94, that is engagable with the recesses 83*a,b* on the gate wheels 62, 64.

The tumbler wheel assemblies 48, 50, 52 are configured to prevent surreptitious attack by radiographic imaging methods. To that end, the features of each of the tumbler wheel assemblies 48, 50, 52, including but not limited to projections 80*a,b*, 82*a,b* and recesses 81*a,b*, 83*a,b*, possess a rotational symmetry about axis 53 so that no single feature can be imaged in relation to the position of the true gates defined by recesses 83*a,b*. In addition, the tumbler wheel assemblies 48, 50, 52 lack change key openings because of the construction of the combination change key 140, described herein. Moreover, the true gates 82 on each of the tumbler wheel assemblies 48, 50, 52 are substantially indistinguishable or imperceptible from the recesses 81*a,b* defining false gates in a radiographic image. Moreover, the constructive overlapping in the radiographic image of the recesses 81*a,b*, 83*a,b* of a plurality of tumbler wheel assemblies 48, 50, 52 further obscures the angular location of the true gates defined by recesses 83*a,b* about the outer periphery of gate wheels 62, 64.

With reference to FIGS. 3, 4, 5A and 5B and in accordance with the principles of the invention, the combination lock 10 further includes a combination scrambler or scrambler mechanism, indicated generally by reference numeral 96, which is configured to prevent surreptitious attack by operation of an automatic dialer. Specifically, the scrambler mechanism 96 rotates, for example, front tumbler wheel assembly 48 if an incorrect combination is entered and the dial 16 is pressed inwardly to attempt to retract the lock bolt 34. The scrambler mechanism 96 includes a scrambler assembly 98 mounted to the lock case 14, an actuator 100 operatively coupled with the scrambler assembly 98 by a drive pawl 102, and a spaced-apart pair of projections 104, 106 projecting from the rear cover 15. The actuator 100 includes an annular disk 108 having a central opening aligned concentrically with, and rotatable about, an arbor 110 of the drive cam 46. The actuator 100 is also movable in an axial direction when the dial 16 and the spindle 28 are displaced axially relative to the tumbler post 30 by the application of an inwardly-directed force to knob 20.

Extending circumferentially about the annular disk 108 of the actuator 100 and spaced radially inward from its outer peripheral edge is a pair of cam surfaces or inclined ramps 112, 114. The inclined ramps 112, 114 are an angularly spaced approximately 180° apart and are located at equal radii from the center of the annular disk 108, although the invention is not so limited. The inclined ramps 112, 114 are radially positioned for contacting the projections 104, 106, respectively, on the rear cover 15 when the actuator 100 is moved axially, as shown best by directional arrow 115 in FIG. 7. In this manner, the inclined ramps 112, 114 and the projections 104, 106 cooperate for transforming translation of the spindle 28 into rotation of the actuator 100. Each inclined ramp 112, 114 is declined inwardly away from a generally-planar surface of the annular disk 108 facing the rear cover 15. The length of each inclined ramp 112, 114 and the travel distance of the projections 104, 106 thereon are chosen to provide sufficient movement of the drive pawl 102 for actuating the scrambler assembly 98, as described herein.

The actuator 100 includes a lobe or cam surface 101 coupled with the flange 88 of the fence bar 86. As the actuator 100 is rotated by an inwardly-directed force displacing the dial 16 and the spindle 28 axially relative to the tumbler post 30, a portion of flange 88 is guided along the cam surface 101. When an improper combination is dialed using dial 16, the cam surface 101 has one portion that suspends fence bar 86 so that the fences 90, 91, 92 have a non-contacting relationship with the corresponding one of the tumbler wheel assemblies 48, 50, 53 and permits the fences 90, 91, 92 to drop toward the tumbler wheel assemblies 48, 50, 52 when the dial 16 is pressed inwardly to test the dialed combination. The cam surface 101 has another portion of lesser radius that permits the lever nose 43 of bolt lever 42 to drop into the notch 44 in the drive cam 46 when a proper combination is entered.

One end of the drive pawl 102 is pivotally coupled to an arm 116 projected outwardly from a peripheral rim of the annular disk 108. Arm 116 provides the mechanical drive link between the scrambler assembly 98 and actuator 100. Projecting outwardly from an opposite free end of the drive pawl 102 is a pinion-engagement spur or nib 118 configured for engaging the scrambler assembly 98 when the actuator 100 is rotated. A spring-engaging flange 120 is provided near the midpoint of the drive pawl 102 and provides an attachment point for a biasing element 123, such as an extension spring.

The scrambler assembly 98 includes a lever 122 pivotally coupled with the lock case 14 and a wheel-scrambling element 124 rotatably coupled with the lever 122. Lever 122 includes a spring-engaging flange 125 that is resiliently coupled to the spring-engaging flange 120 by biasing element 123. The biasing element 123 applies a biasing force that urges the wheel-scrambling element 124 to normally have a non-contacting relationship with the outer wheels 58, 60 of front tumbler wheel assembly 48. The wheel-scrambling element 124 includes a pinion 126 and a pinion 128 of greater diameter than pinion 126. The pinions 126, 128 are rotatably attached or affixed by a stud or pin 129 with the lever 122. Adjacent side faces of the pinions 126, 128 are joined together so that the pinions 126, 128 rotate collectively about pin 129. It is contemplated that the pinions 126, 128 may comprise either a single-piece, unitary structure or joined individual components. A plurality of teeth 130 encircling pinion 128 are configured for meshing with the teeth 78 of outer wheel 60 to provide a positive driving engagement. Pinion 126 has a plurality of spaced teeth 132 configured to permit selective mechanical coupling with the nib 118 on the drive pawl 102.

The center of pinion 126 is offset from an axis of rotation 131 defined by the pin 129. The center of pinion 128 is aligned with the axis of rotation 131 so that teeth 130 mesh with teeth 78 of outer wheel 60 regardless of the angular orientation of pinion 128. As the pinions 126, 128 collectively rotate, the rotation of pinion 126 is eccentric about the axis of rotation 131. As a result of the eccentricity, successive incremental angular rotations imparted by pinion 128 to outer wheel 60 from successive or consecutive attempts to open the combination lock 10, after entry of corresponding improper combinations, are not predictable among the successive attempts.

Figure 5B:
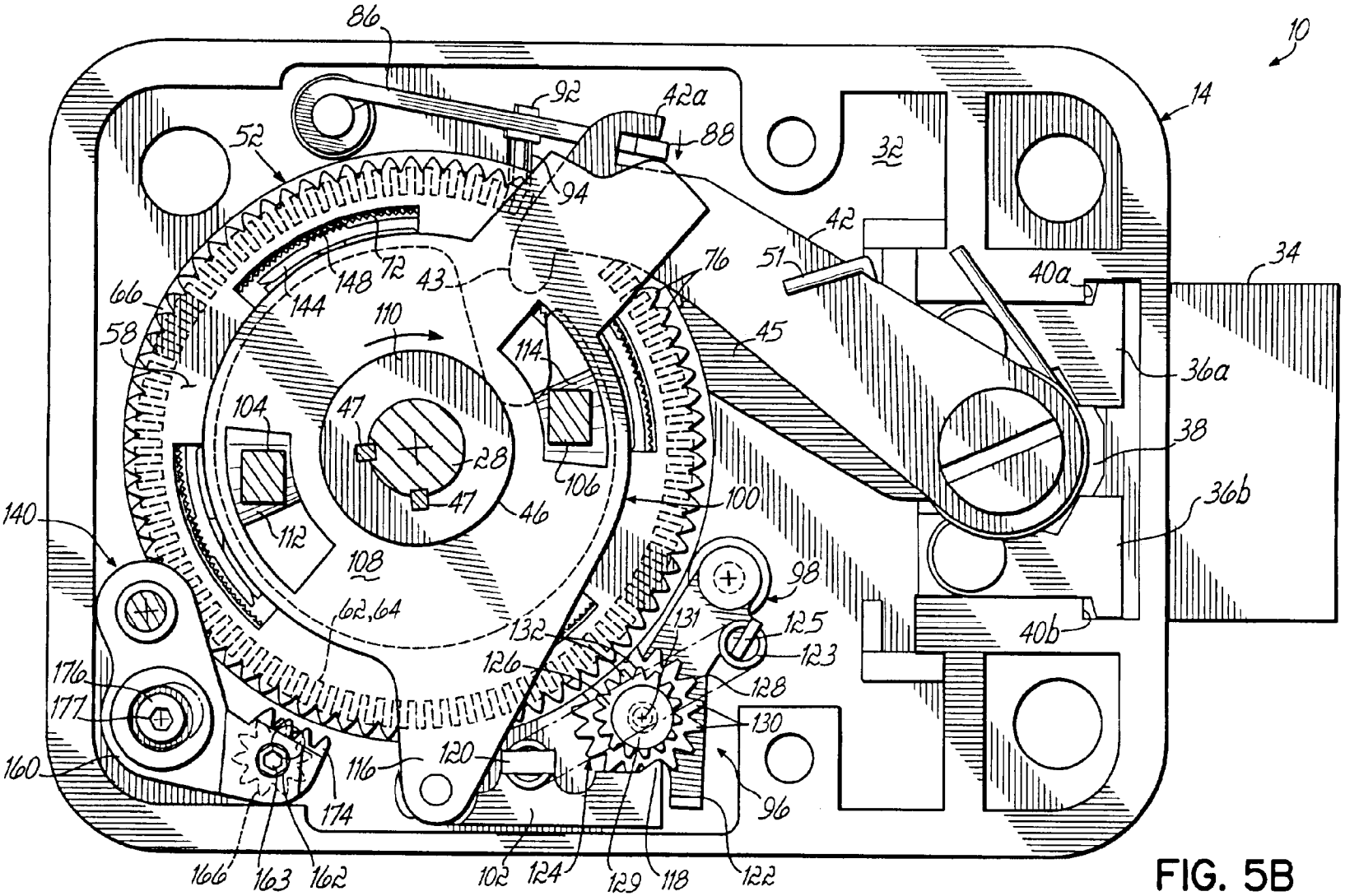
FIGS. 5B–5F are rear elevation views similar to FIG. 5A showing the operation of a combination scrambler according to the principles of the invention.
Figure 5C:
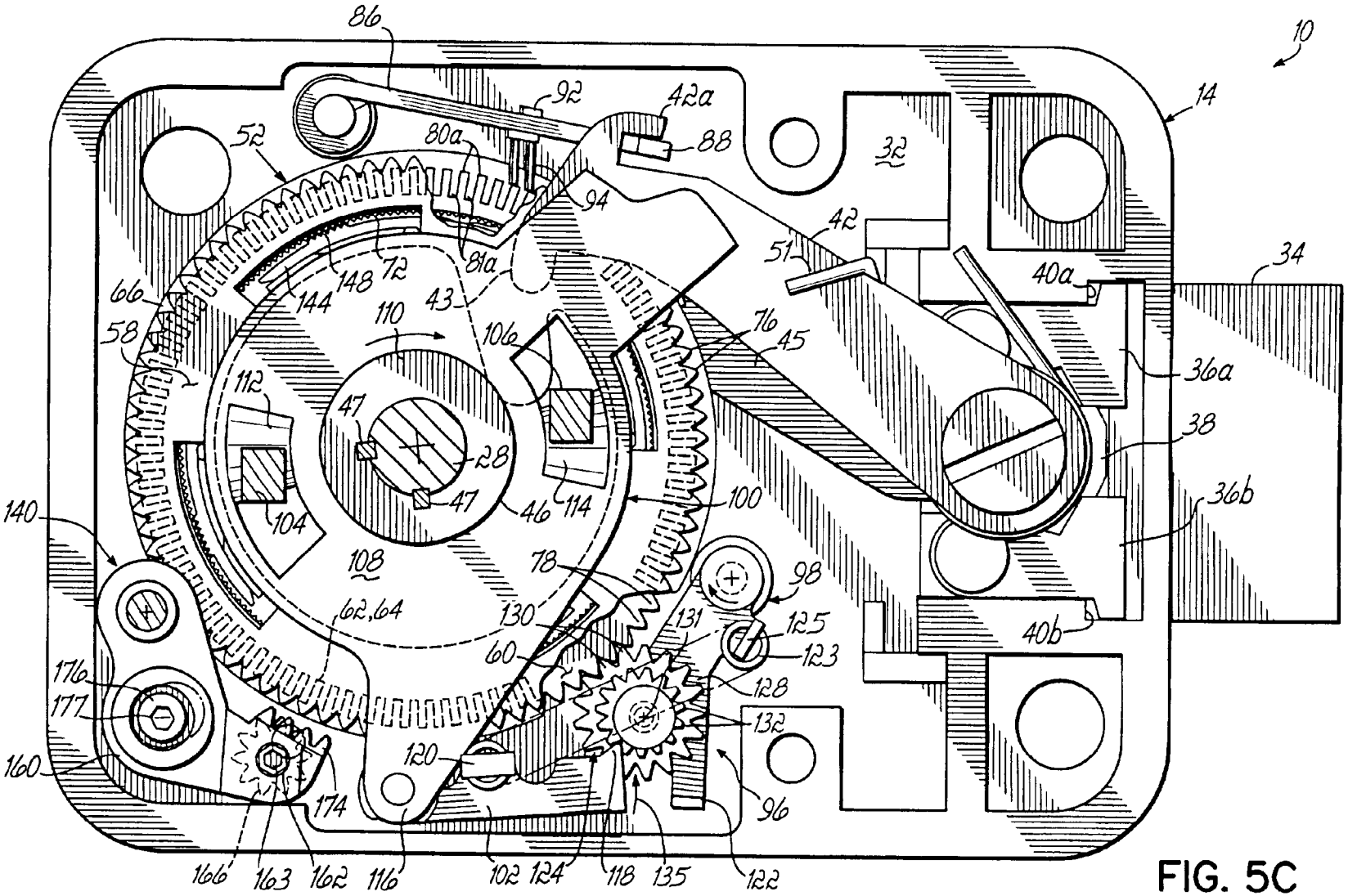
Figure 5D:
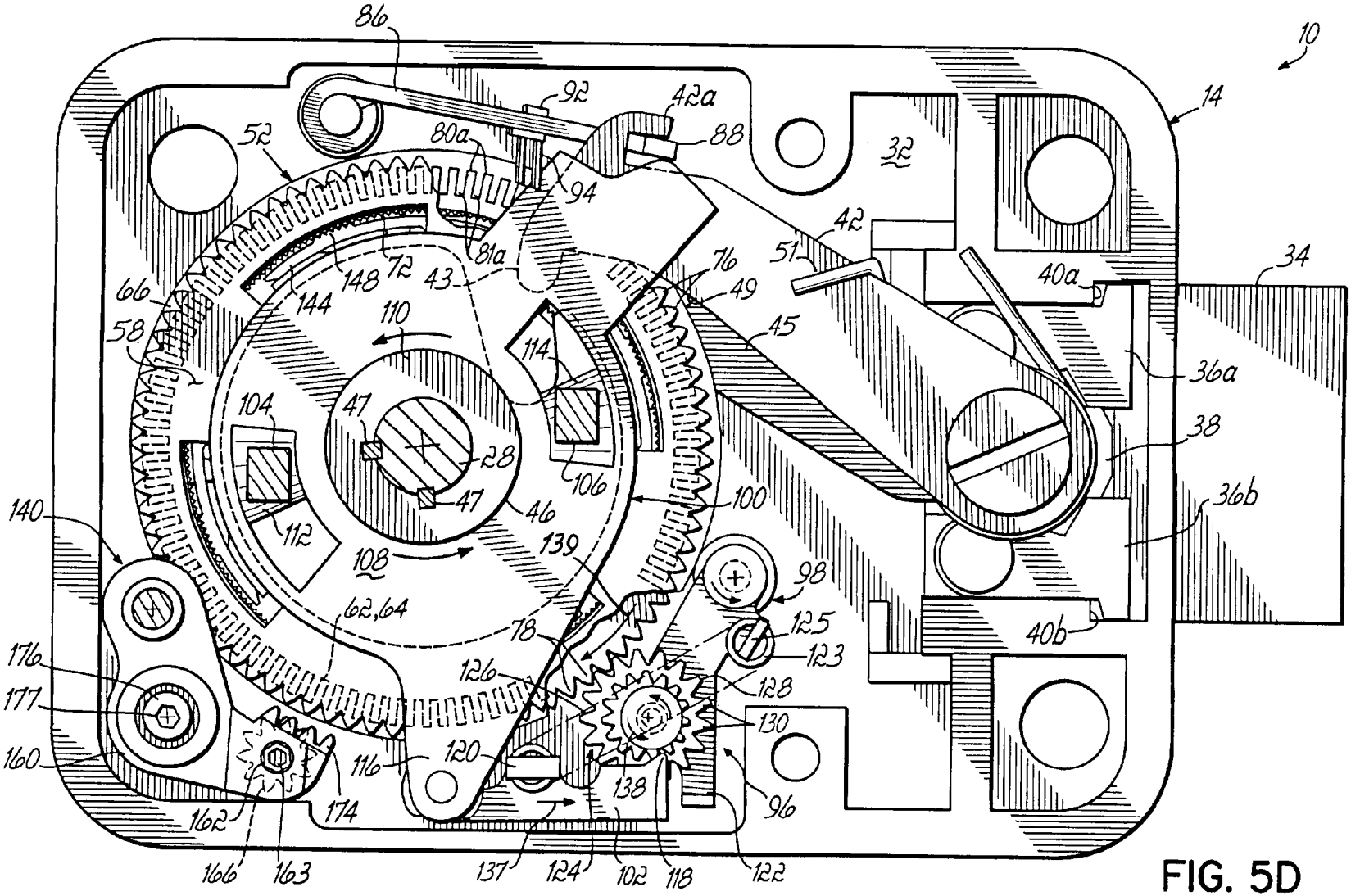
Figure 5E:
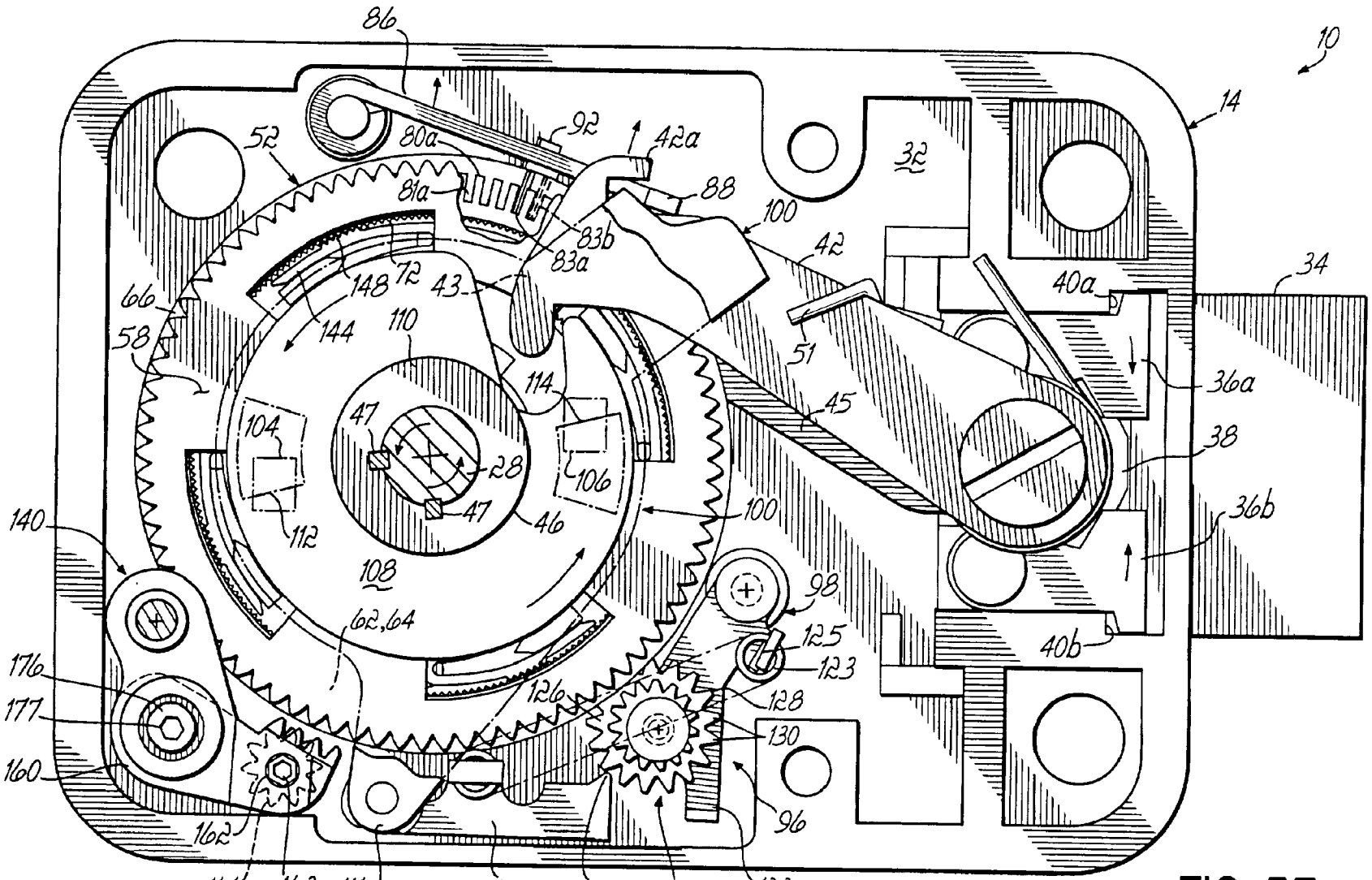
Figure 6:
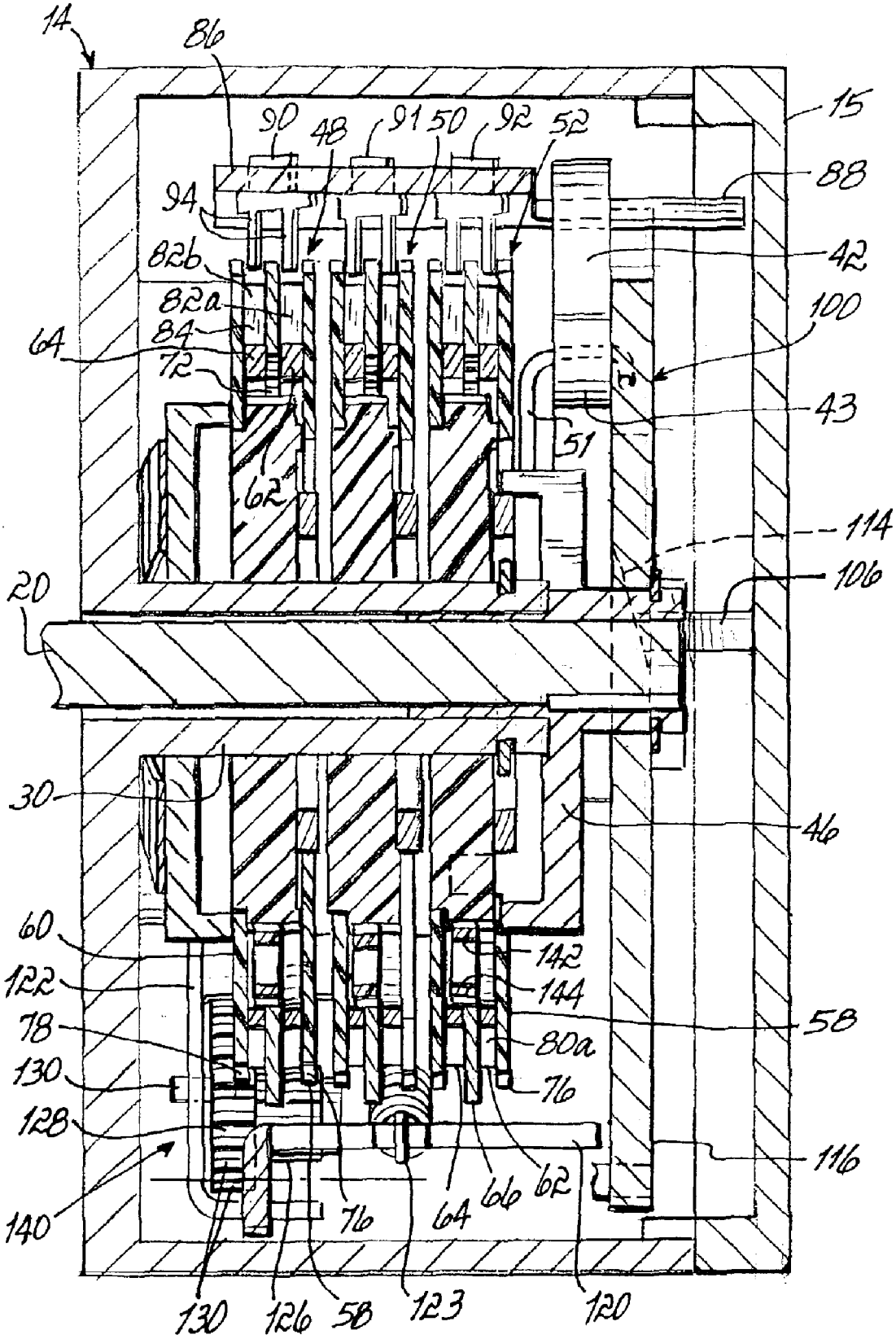
FIG. 6 is a partial cross-section view taken along line 6—6 of FIG. 5A in which the combination lock is in the unlocked condition.
Figure 7:
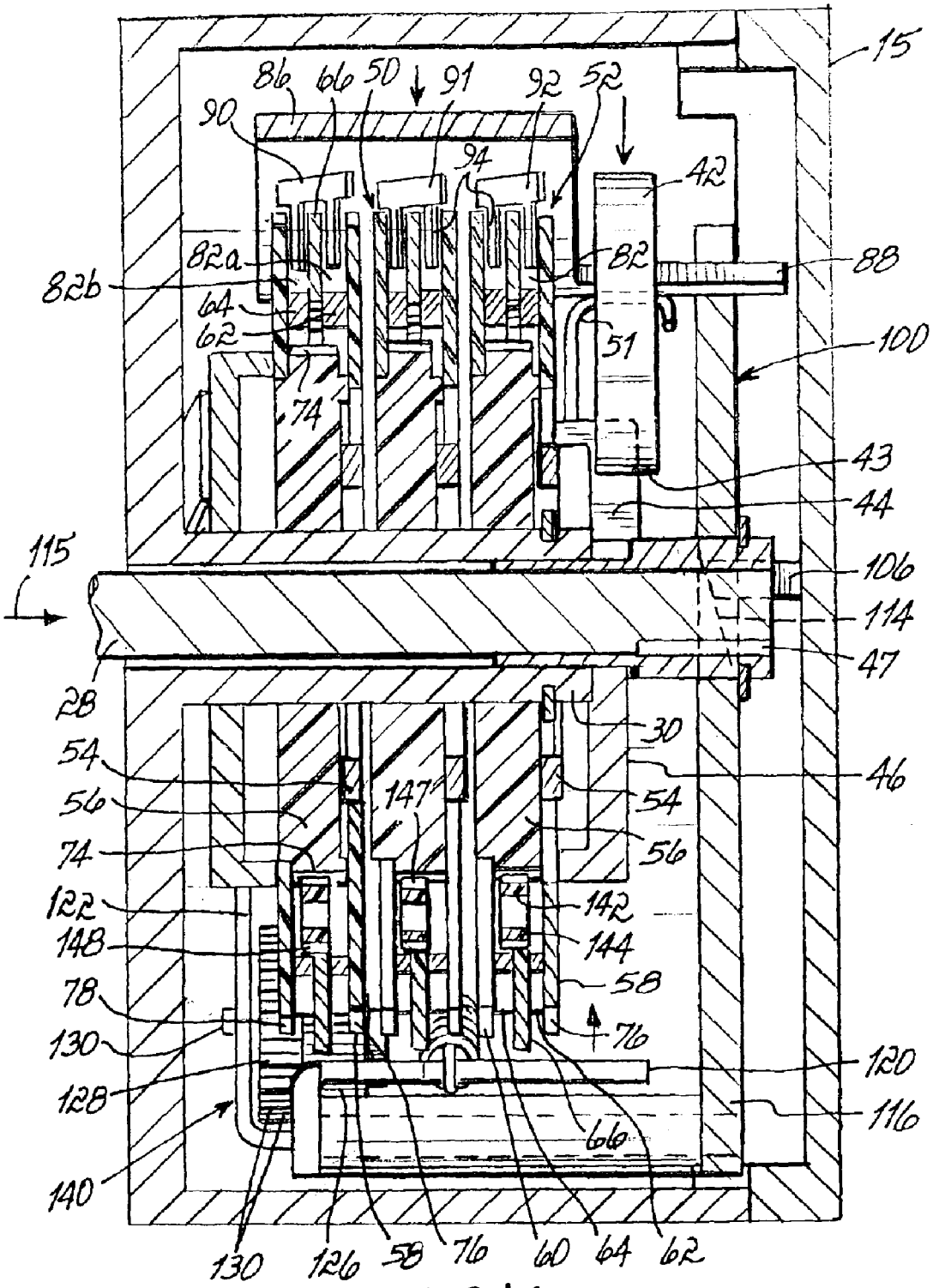
FIG. 7 is a partial cross-section view similar to FIG. 6, in which the combination dial and spindle have been pushed inwardly into the lock case to verify the accuracy of a dialed combination.

In operation and with reference to FIGS. 4, 5A–E, 6 and 7, the pinion 128 of the wheel-scrambling element 124 is initially spaced from front tumbler wheel assembly 48, as shown in FIGS. 5A and 6, due to the biasing force applied by biasing element 123. A combination is dialed using dial 16 and the dial 16 and spindle 28 are collectively pushed axially into the lock case 14 to verify whether or not the dialed combination is correct. As shown in FIGS. 5B, 5C, and 7, the inward movement of the dial 16 displaces the spindle 28 and the actuator 100 axially toward the rear cover 15, which causes each of the projections 104, 106 to engage a corresponding one of the inclined ramps 112, 114. Continued axial movement of the spindle 28 toward the rear cover 15 slidingly moves the projections 104, 106 along the ramps 112, 114 which causes the actuator 100 to rotate in the direction of directional arrow 134 (FIG. 5B). As the actuator 100 rotates, the lever 122 pivots toward the front tumbler wheel assembly 48 generally in the direction of directional arrow 135 (FIG. 5C) so that the teeth 130 on pinion 128 mesh with the teeth 78 on outer wheel 60 and the drive pawl 102 pivots so as to engage nib 118 with one of the teeth 132 of pinion 126.

Entry of an improper combination results in the lever nose 43 not being engaged with notch 44 as at least one of the fences 90, 91, 92 is not angularly aligned with the corresponding recesses 83*a,b* and, as a result, contacts a radially outermost portion of the projections 80*a,b*. After the combination has been verified, the dial 16 is released and the spindle 28 is biased to translate outwardly, which causes rotation of the actuator 100 in the sense of directional arrow 136, as shown in FIG. 5D. As the projections 104, 106 slidingly move along the inclined ramps 112, 114, the drive pawl 102 moves generally in the direction of directional arrow 137, while the nib 118 is engaged with one tooth 132 of pinion 126, which causes the pinions 126, 128 to collectively rotate in the sense of directional arrow 138. The collective rotation of pinions 126, 128 with the teeth 130 of pinion 128 meshed with the teeth 78 of outer wheel 60 precipitates rotation of the front tumbler wheel assembly 48, including the gate wheels 62, 64, in the sense of directional arrow 139. Thus, each time an improper combination is entered and the combination is checked, the scrambler mechanism 96 causes the front tumbler wheel assembly 48 to rotate through an angle. The scrambler mechanism 96 returns to the position shown in FIG. 5A with the nib 118 disengaged from pinion 126 and the pinion 128 spaced apart from the front tumbler wheel assembly 48 in anticipation of the entry of another combination. If another improper combination is entered and checked, the scrambler mechanism 96 will rotate front tumbler wheel assembly 48 through an angle in the direction of directional arrow 139 that differs from the angle of the previous unsuccessful attempt to unlock the combination lock 10.

According to the principles of the invention, the scrambler mechanism 96 defeats or, at the least, delays surreptitious attack from an automatic dialer operating in a systematic manner to unlock the combination lock 10. Specifically, the scrambler mechanism 96 rotates front tumbler wheel assembly 48 if successive or consecutive improper combinations are entered and the dial 16 is pressed inwardly after each improper combination is enter to attempt to retract the lock bolt 34. The rotation of front tumbler wheel assembly 48 causes the automatic dialer to lose its reference point, after each improper combination is entered, so that a succession of entered improper combinations is not systematic. Moreover, the eccentricity of the rotation of pinion 126 about the axis of rotation 131 operates to vary the angle or angular arc through which the front tumbler wheel assembly 48 rotates, among successive failed attempts to unlock combination lock 10. As a result, the automatic dialer cannot rely on a predictable angular position of the front tumbler wheel assembly 48 because of the unpredictable variation in its angular orientation imparted by the scrambler mechanism 96. Therefore, the combination lock 10 is less likely to be compromised by the action of the automatic dialer.

If a proper combination is entered, the recesses 83*a,b* of each tumbler wheel assembly 48, 50, 52 are aligned angularly with the corresponding one of the fences 90, 91, 92. The fence bar 86 pivots toward the tumbler wheel assemblies 48, 50, 52 and the prongs 94 of each of the fences 90, 91, 92 enter recesses 83*a,b* on the corresponding gate wheels 62, 64. As a result of the increased travel distance available to the fence bar 86, the bolt lever 42 lowers by the action of spring 51 so that the lever nose 43 engages the notch 44 in the drive cam 46, which is oriented by the entry of a proper combination in angular position with the notch 44 confronting the lever nose 43, as shown in FIG. 5E. When the dial 16 and spindle 28 are pushed inwardly into the lock case 14 to verify whether or not the dialed combination is correct, the drive cam 46 is rotated and, due to the engagement between the lever nose 43 and notch 44, the bolt lever 42 moves in a direction for retracting the lock bolt 34. The actuator 100 moves toward the rear cover 15 and the projections 104, 106 engage the ramps 112, 114, respectively. The locking pawls 36*a,b* are pivoted by release mechanism 38 to a non-contacting relationship with the stop surfaces 40*a,b* so that the lock bolt 34 can be retracted for unlocking the combination lock 10.

Figure 5F:
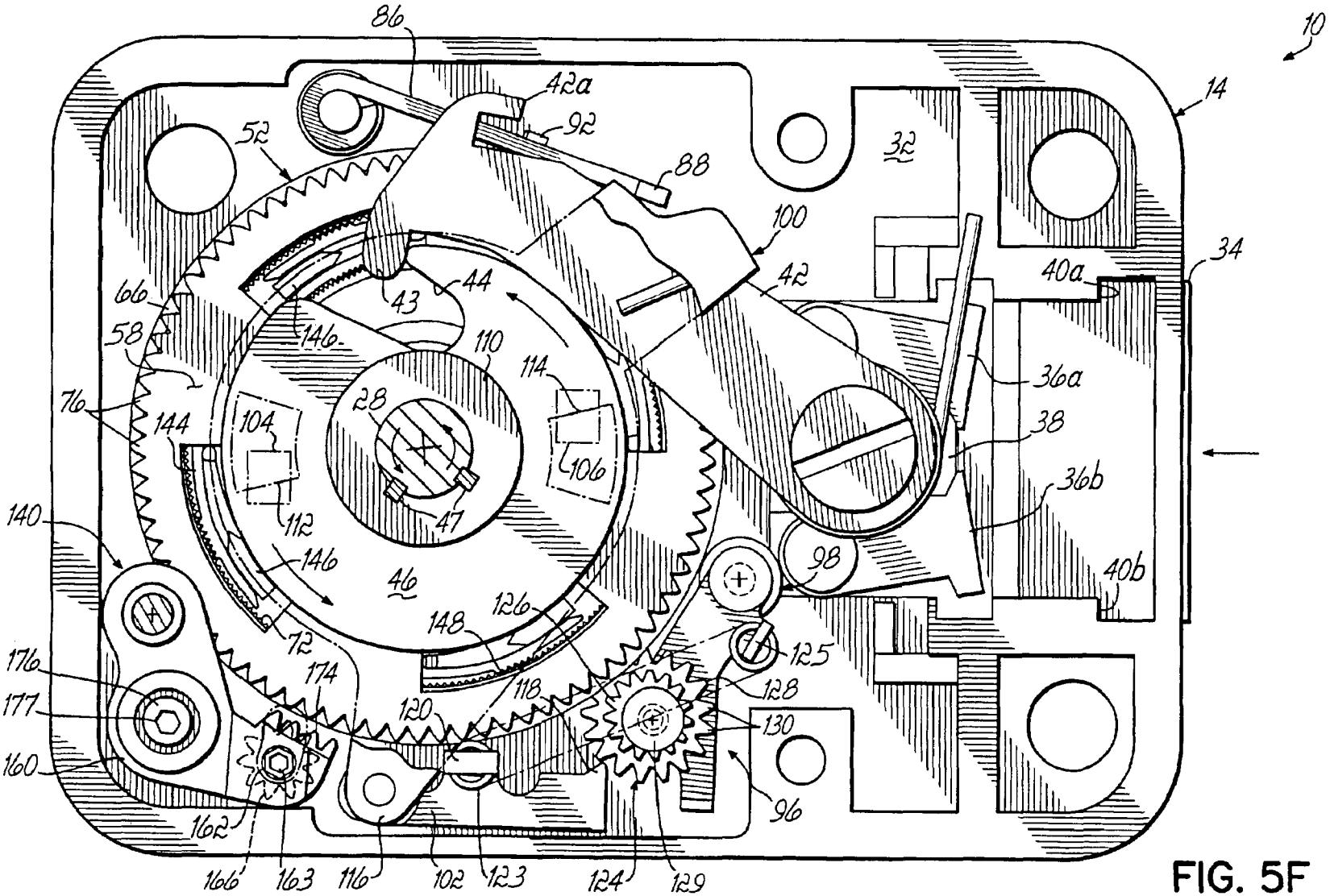

Continued rotation of the drive cam 46 causes the lock bolt 34 to retract into the lock case 14, which disengages the lock bolt 34 from a strike (not shown), or the like, associated with a frame surrounding door 12, as shown in FIG. 5F, so that the supporting door 12 may be opened. The teeth 130 of pinion 128 are meshed with the teeth 78 of the outer wheel 60 and the nib 118 is engaged with one tooth 132 of pinion 128. However, as the projections 104, 106 slidingly move along the inclined ramps 112, 114, the pinions 126, 128 cannot collectively rotate as the fence 92 is engaged with the recesses 83*a,b* of front tumbler wheel assembly 48. As a result, the scrambler assembly 98 is not effective for altering the angular orientation of the front tumbler wheel assembly 48. The scrambler mechanism 96 returns to the position shown in FIG. 5A with the nib 118 disengaged from pinion 128 and pinion 126 spaced apart from the front tumbler wheel assembly 48 in anticipation of the entry of another combination. The dial 16 is turned to extend the lock bolt 34 by operation fo travel arm 45 and drive cam 41 out of the lock case 14 to reestablish the locked position (FIG. 5A).

With reference to FIGS. 2A, 3, and 8A–11 and according to the principles of the invention, the combination lock 10 is equipped with a combination change mechanism or key 140 that is operative for decoupling the tumbler wheel assemblies 48, 50, 52 from rotating with the spindle 28 and drive cam 46 so that the lock combination may be changed. To that end, the outer wheels 58, 60 of each of the tumbler wheel assemblies 48, 50, and 52 incorporate a releasable mechanical linkage or coupling that provides a selective drive coupling between the drive cam 46 and the outer wheels 58, 60 and, therefore, a selective drive coupling between the spindle 28 and the gate wheels 62, 64. Specifically, the outer wheel 58 of, for example, rear tumbler wheel assembly 52 includes a plurality of, for example, four arcuate inner spring arms 142 and a corresponding plurality of four arcuate outer spring arms 144. Pairs of the inner and outer spring arms 142, 144 are releasably spread apart or separated from each another, in a coupled state, by a corresponding one of a plurality of spreading elements, such as arcuate wedges 146, provided on outer wheel 60 on tumbler wheel assembly 52. The arcuate wedges 146 are positioned on the side of outer wheel 60 facing outer wheel 58. It is appreciated that the outer wheels 58, 60 of the other two tumbler wheel assemblies 48, 50 also have inner and outer spring arms 142, 144 and wedges 146, respectively, identical to those of rear tumbler wheel assembly 52 and that the following discussion is equally applicable to tumbler wheel assemblies 48, 50.

The inner spring arms 142 extend circumferentially about the outer wheel 58 and the outer spring arms 144 likewise extend circumferentially about the outer wheel 58 at a greater circumference of larger radius. Pairs of the inner and outer springs arms 142, 144 are angularly positioned so that one of the outer springs arms 144 is spaced radially outwardly from a corresponding one of the inner spring arms 142. Each inner spring arm 142 has a plurality of spaced apart teeth 147 facing radially inward toward the center of the outer wheel 58. Similarly, each of the outer spring arms 144 has a plurality of spaced apart teeth 148 facing radially outward away from the center of the outer wheel 58.

The inner and outer spring arms 142, 144 have a cantilevered attachment at one end to the outer wheel 58. The free end of each inner spring arm 142 includes an inclined surface 150 and, similarly, the free end of each outer spring arm 144 includes an inclined surface 152 that confronts the inclined surface 150. One end of each wedge 146 includes a tapered head 154 that is oriented circumferentially in a direction that confronts the respective free ends of a corresponding pair of the inner and outer spring arms 142, 144. The tapered head 154 and the inclined surfaces 150, 152 cooperate to guide the wedge 146 between the corresponding pair of inner and outer spring arms 142, 144 when at least one of the outer wheels 58, 60 is rotated for mechanically engaging the outer wheels 58, 60 to provide the coupled state.

When the outer wheels 58, 60 are in the coupled condition, each of the wedges 146 is positioned between a corresponding pair of inner and outer spring arms 142, 144. Specifically, the wedges 146 operate to separate the inner and outer spring arms 142, 144 to provide a drive coupling between the drive hub 56 and the assembly consisting of the middle wheel 66 and gate wheels 62, 64. More specifically, in the coupled condition (FIGS. 8A and 9), the teeth 147 of the inner spring arms 142 are meshed with the teeth 74 of the drive hub 56 and the teeth 148 of the outer spring arms 144 are meshed with the teeth 72 on the inner peripheral rim of the middle wheel 66. When the outer wheels 58, 60 are in an uncoupled condition (FIGS. 8C and 10), the rear tumbler wheel assembly 52 is uncoupled from its drive hub 56 so that rotation of the spindle 28 by dial 16 does not induce rotation of rear tumbler wheel assembly 52. In the uncoupled condition, the rear tumbler wheel assembly 52 is freely rotatable relative to its drive hub 56. It is appreciated that the combination change key 140 is operative for coupling and uncoupling the front and middle tumbler wheel assemblies 48, 50 from their respective drive hubs 56 in a manner similar to that described for front tumbler wheel assembly 52 so that each number of the lock combination can be changed.

With reference to FIGS. 8A–D, 9, 10 and 11, the uncoupled state between the tumbler wheel assemblies 48, 50, 52 and the associated drive hub 56 is provided by rotating outer wheel 58 relative to outer wheel 60 for each of the tumbler wheel assemblies 48, 50, 52 so that the wedges 146 are disengaged from the inner and outer spring arms 142, 144. To that end, the combination change key 140 includes a change lever 160, a gear drive shaft 162 extending through the change lever 160, a plurality of, for example, three rotatable spur gears 164, 166, 168 coupled with the gear drive shaft 162, a corresponding plurality of toothed sections 170, 172, 174 provided on the change lever 160, a change key drive 176, and a change key cam 178 with which the change key drive 176 is engaged. The change key drive 176 and the change key cam 178 cooperate to provide the pivoting action of the change lever 160 when the change key drive 176 is rotated about its rotation axis.

The combination change key 140 is normally spring-biased so that the spur gears 164, 166, 168 and toothed sections 170, 172, 174 have a non-contacting relationship with the corresponding outer wheels 58, 60. It is appreciated that the number of spur gears and toothed sections will correlate with the number of tumbler wheel assemblies. The spur gears 164, 166, 168 are identical and have teeth configured for engaging the teeth 78 of outer wheel 60 of a corresponding one of the tumbler wheel assemblies 48, 50, 52. Similarly, the toothed sections 170, 172, 174 are identical and have teeth configured for engaging the teeth 76 of the other outer wheel 58 of a corresponding one of the tumbler wheel assemblies 48, 50, 52.

Figure 8A:
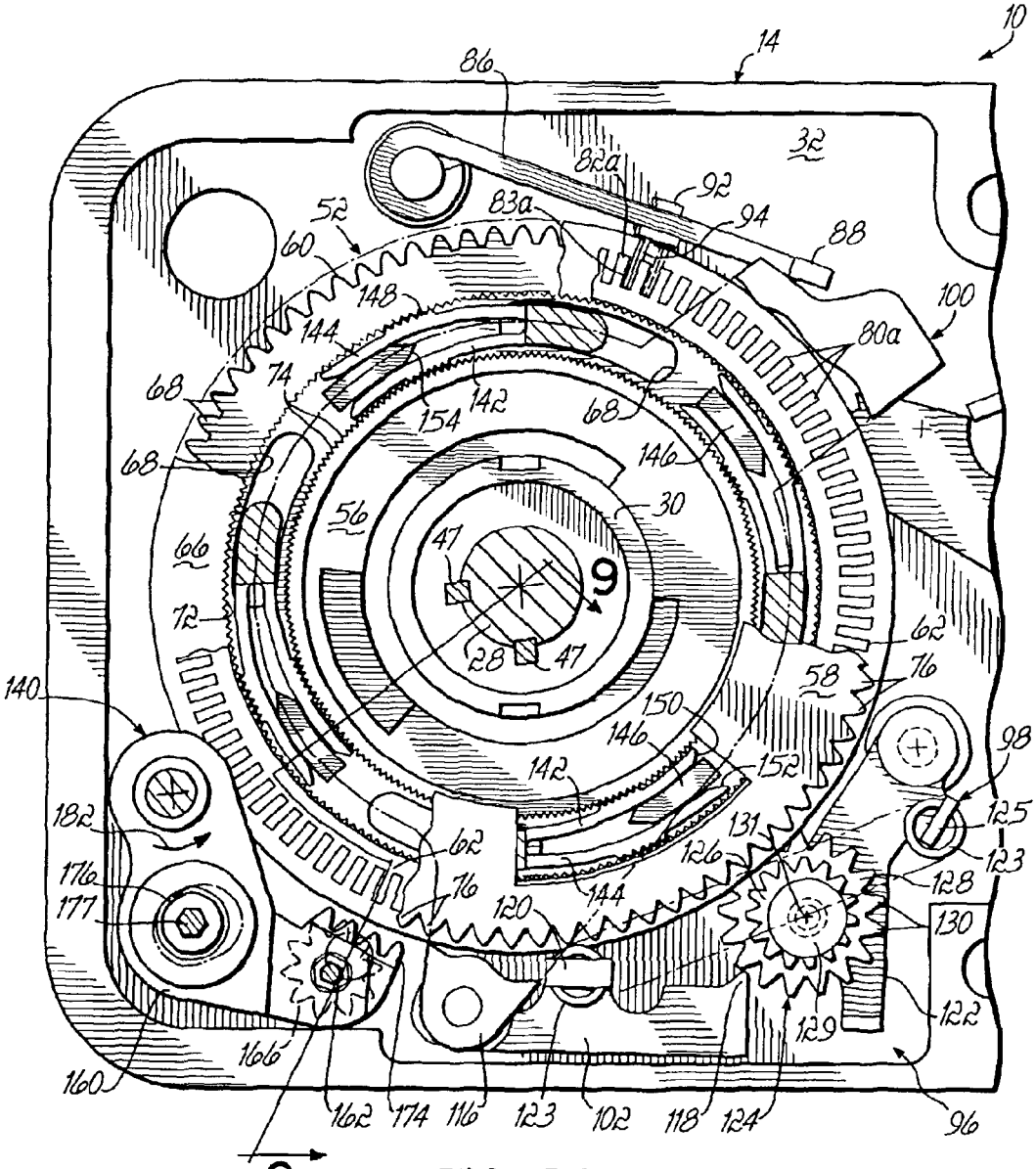
FIGS. 8A–8C are cross-sectional views of a portion of the combination lock of the invention illustrating operation of a combination change key for changing the lock combination.

The head of the change key drive 176 includes a drive recess 177 capable of being engaged by a complementary portion of a driving tool or implement (not shown), which is used to apply a pivoting force via the change key drive 176 that moves the combination change key 140 into engagement with outer wheels 58, 60 of each of the tumbler wheel assemblies 48, 50, 52 (FIG. 8A). Similarly, the head of gear drive shaft 162 also includes a drive recess 163 capable of being engaged by a complementary portion of another driving tool 180 for rotating the spur gears 154, 156, 158 relative to the housing in one rotational direction for uncoupling the wedges 146 from the inner and outer spring arms 142, 144 and in an opposite rotational direction for inserting the wedges 146 between the inner and outer spring arms 142, 144.

The combination change key 140 lacks any identifying feature or features, such as openings or rivets, that would be visible in a radiographic image of the combination lock 10. As a result, no feature of the combination change key 140 bears a predictable relationship relative to the gate(s) of the combination lock 10 in a radiographic image. It is apparent that the spring arms 142, 144 and wedges 146 of each tumbler wheel assembly 48, 50, 52 have rotational symmetry about axis 53.

In use and with reference to FIGS. 8A–D, a proper combination is entered so that the fence bar 86 pivots toward the tumbler wheels assemblies 48, 50, 52 and the fences 90, 91, 92 enter the corresponding recesses 83*a,b* defining true gates. A pivoting force is applied to the change key drive 176 in a direction 182 that pivots the combination change key 140 from a home position into engagement with outer wheels 58, 60 of each of the tumbler wheel assemblies 48, 50, 52, as shown in FIG. 8A. The pivoting action is provided by the cooperation between change key drive 176 and change key cam 178. The teeth of spur gear 164 are meshed with the teeth 78 of the outer wheel 60 of the front tumbler wheel assembly 48 and the teeth of the toothed section 170 are meshed with the teeth 76 of the other outer wheel 58 of front tumbler wheel assembly 48. Similarly, the teeth of spur gears 166, 168 and the teeth 78 of the outer wheel 60 of the corresponding one of the tumbler wheel assemblies 50, 52 are meshed and the teeth of the toothed sections 172, 174 and the teeth 76 of the other outer wheel 58 of the corresponding one of the tumbler wheel assemblies 50, 52 are meshed.

Figure 8B:
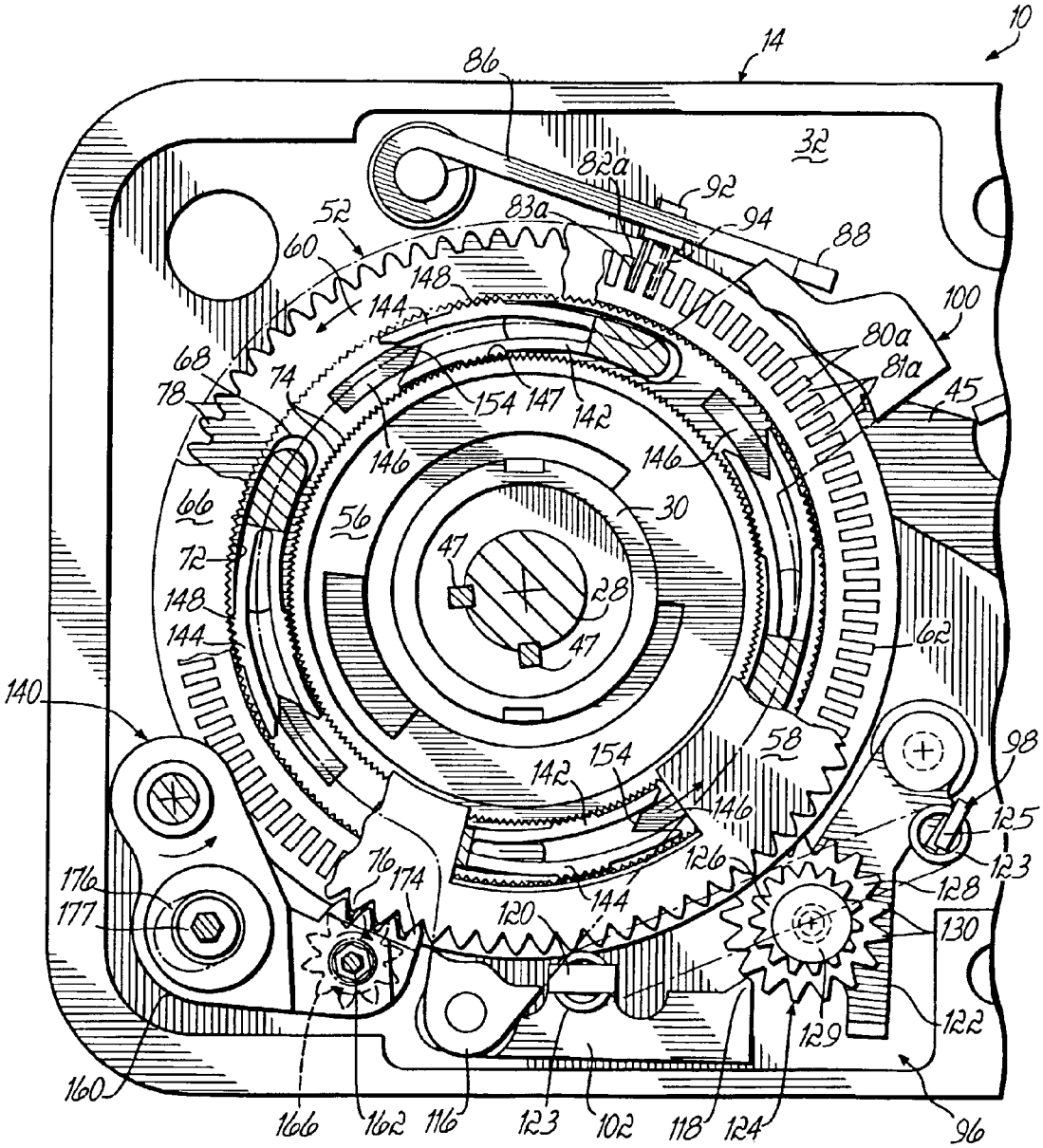

As shown in FIG. 8B, the gear drive shaft 162 is rotated in one direction to simultaneously turn the three spur gears 164, 166, 168 so that the outer wheels 60 are rotated relative to the other outer wheels 58, which are held stationary by the engagement with the corresponding one of toothed sections 170, 172, 174, for removing the wedges 146 from between the inner and outer spring arms 142, 144. The angular orientation of the gate wheels 62, 64 remains stationary as the outer wheels 60 are rotated due to the engagement between the fences 90, 91, 92 and the corresponding recesses 83*a,b*. When the wedges 146 are removed from between the inner and outer spring arms 142, 144, the dial 16, the spindle 28, the drive cam 46, the flies 54, 55, and the drive hubs 56 may be rotated to select a new set of angular positions of the dial 16 to establish a new lock combination.

Figure 8C:
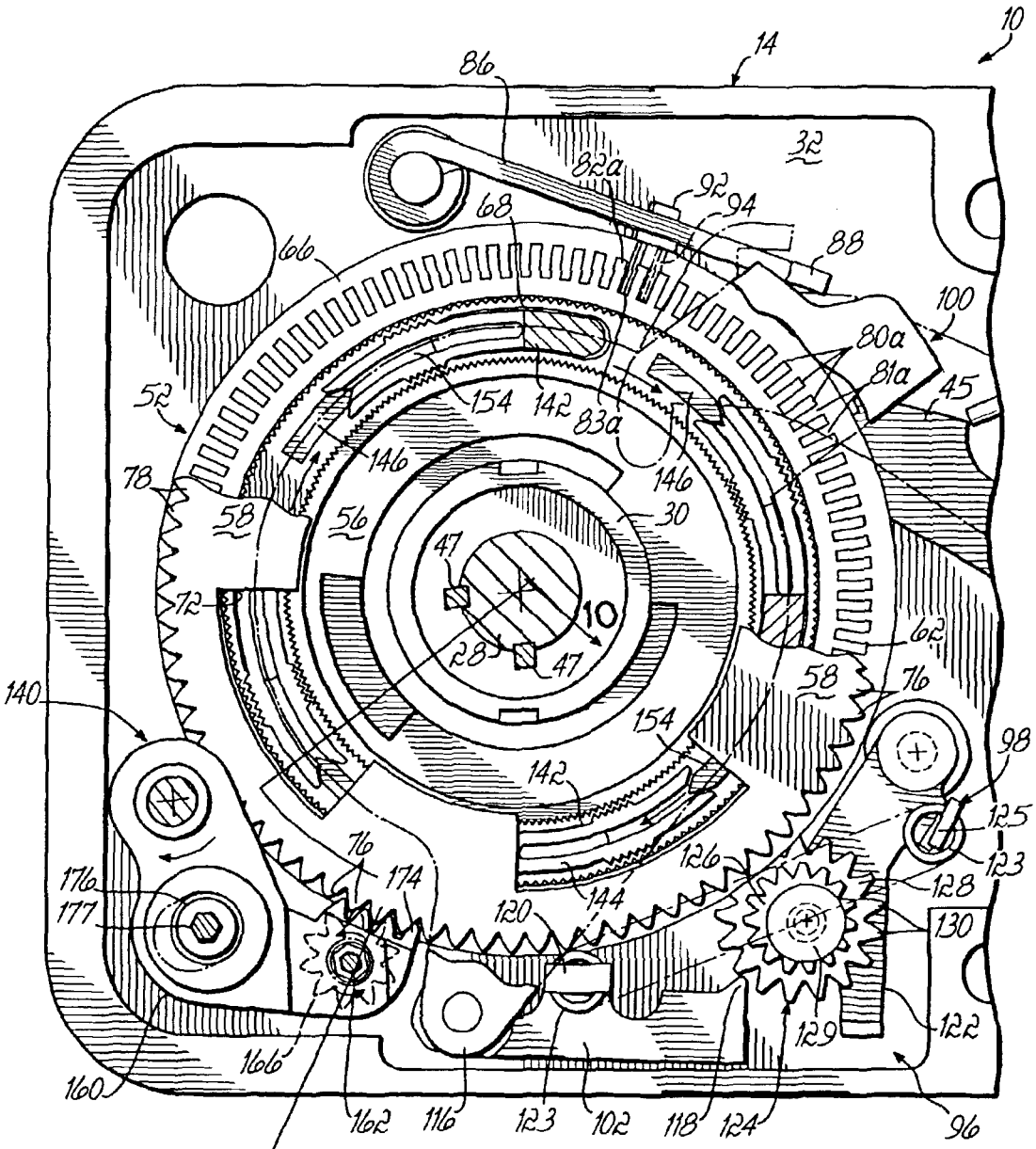
Figure 9:
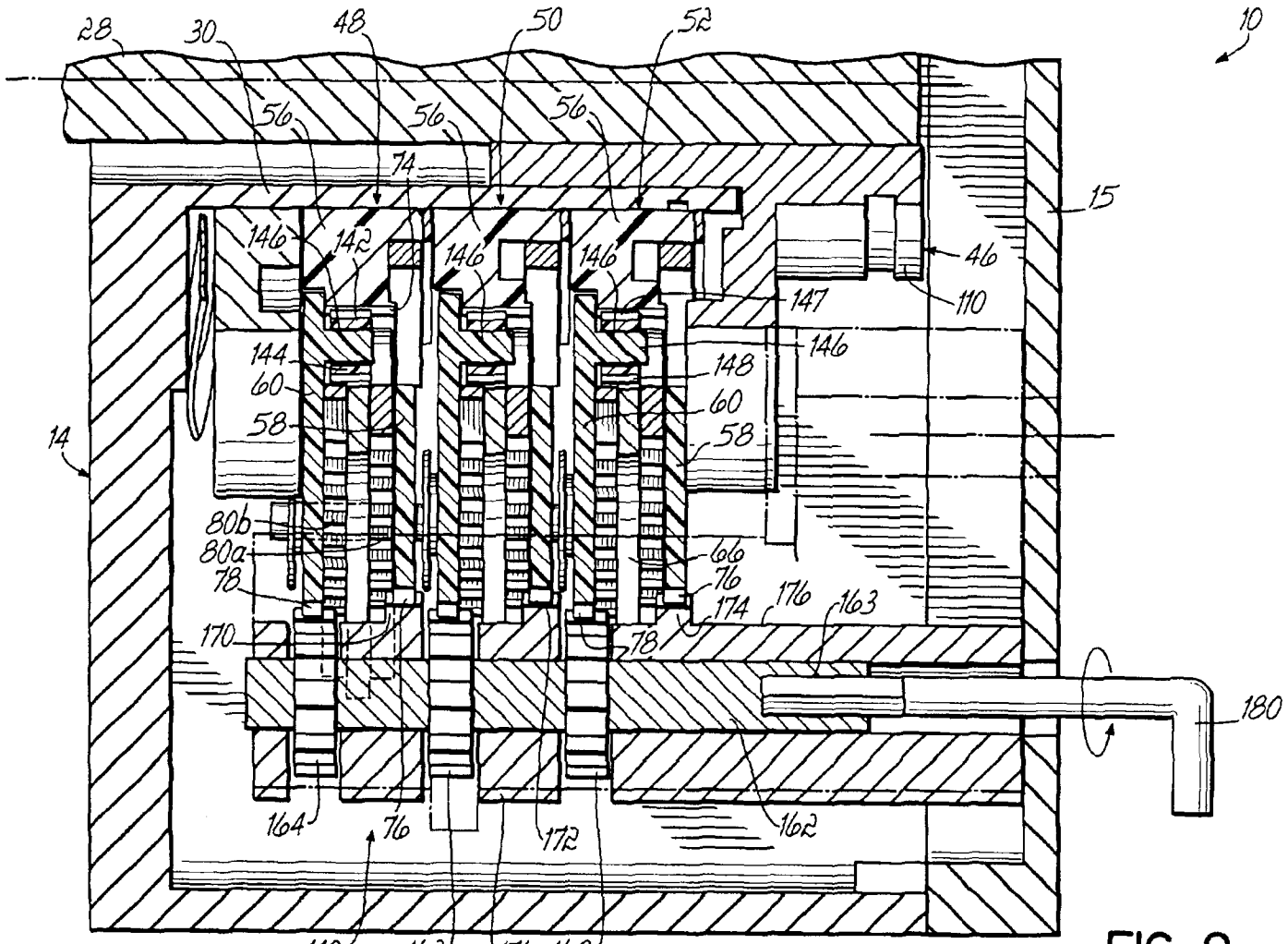
FIG. 9 is a cross-sectional view taken generally along line 9—9 in FIG. 8A.
Figure 10:
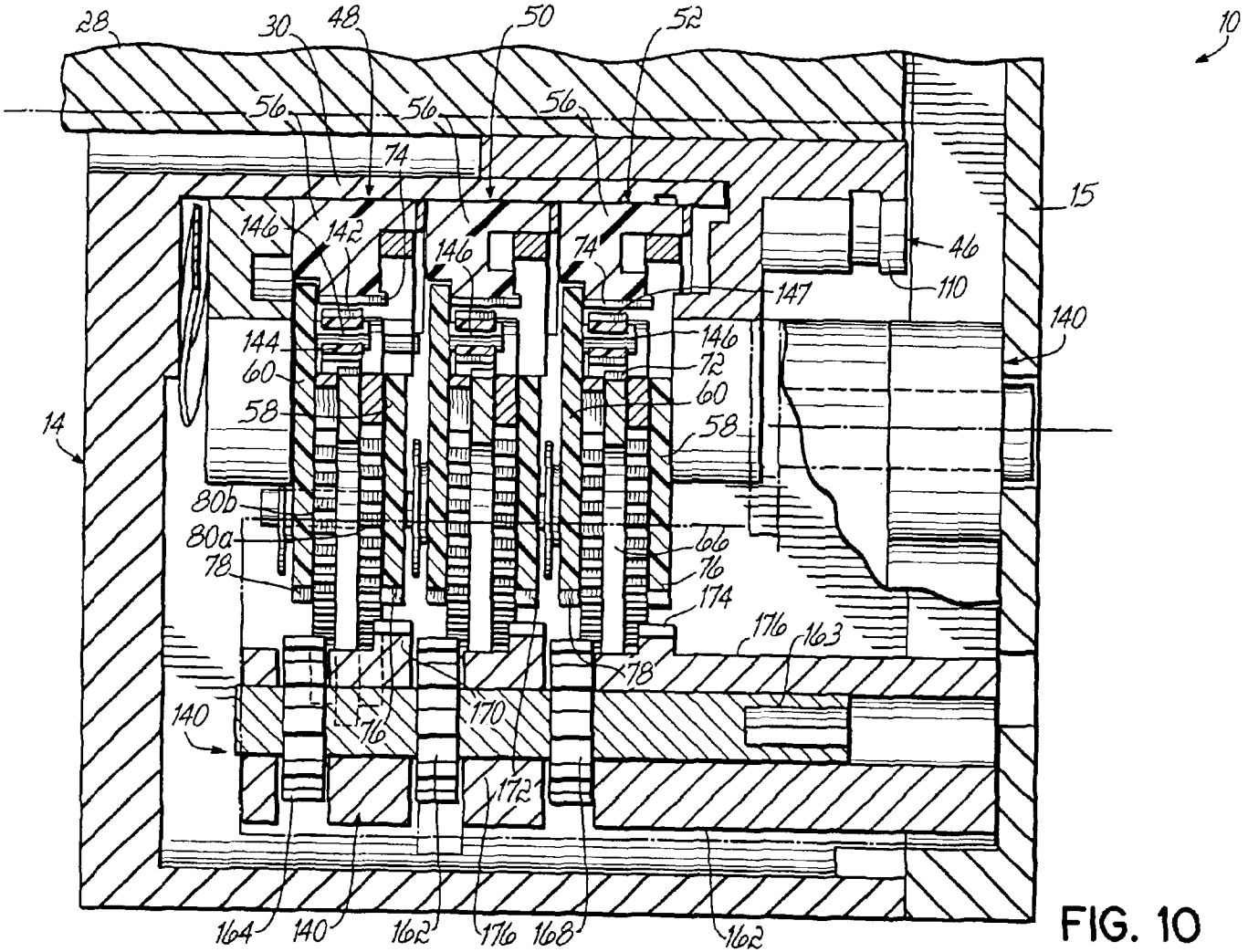
FIG. 10 is a cross-sectional view taken generally along line 10—10 in FIG. 8C.
Figure 11:
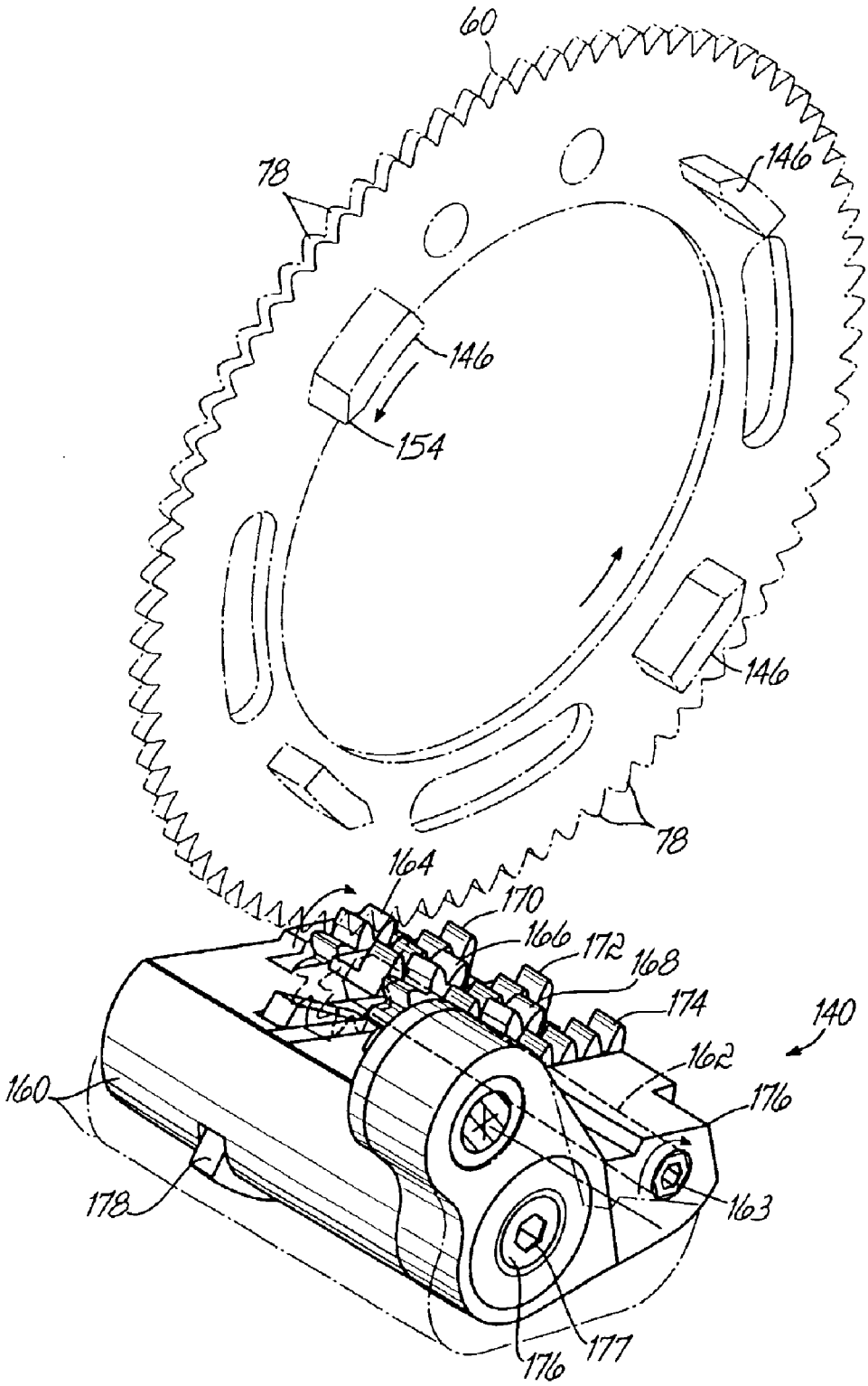
FIG. 11 is a diagrammatic perspective view in which the change key is being actuated to move a gate wheel of one of the tumbler wheel assemblies.

After the new combination is set, the gear drive shaft 162 is rotated in an opposite direction to simultaneously rotate the three spur gears 164, 166, 168 so that the outer wheels 60 are rotated relative to outer wheels 58, which are held stationary in angular position by the engagement with the toothed sections 170, 172, 174, for driving the wedges 146 between the inner and outer spring arms 142, 144, as shown in FIGS. 8A and 8C. The angular position of the gate wheels 62, 64 remains stationary as the outer wheels 60 are rotated due to the engagement between the fences 90, 91, 92 and the corresponding recesses 83*a,b*. When the wedges 146 are engaged with the inner and outer spring arms 142, 144, the outer wheels 58, 60 are returned to the coupled condition and the combination lock 10 is again functional. The pivoting force is released from the change key drive 176 so that the combination change key 140 pivots out of engagement with outer wheels 58, 60 and returns to the home position.

While the present invention has been illustrated by a description of preferred embodiments and while the embodiments have been described in considerable detail, it is not the intention of the Applicant to restrict or in any way limit the scope of the appended claims to such detail. Additional advantages, modifications and adaptations of this invention will become apparent to those skilled in the art upon reviewing this disclosure. The invention in its broader aspects is therefore not limited to the specific details, representative apparatus and method as shown and described. The invention itself should only be defined by the appended claims, wherein I claim:

What is claimed is:

1. A combination lock comprising:

a rotatable first gate wheel having a first gate;

a rotatable second gate wheel having a second gate;

at least one fence capable of being engaged with said first and second gates;

a combination entry device capable of rotating said first and second gate wheels for varying an angular alignment between said first and second gates and said at least one fence, said first and second gates being aligned angularly with said at least one fence upon entry of a proper combination and at least one of said first and second gates being non-aligned angularly with said at least one fence upon entry of one of a plurality of improper combinations;

a lock bolt actuatable between a locked position and an unlocked position;

a lock-bolt drive mechanism capable of actuating said lock bolt from said locked position to said unlocked position after entry of said proper combination and capable of attempting to actuate said lock bolt from said locked position to said unlocked position after entry of one of said plurality of improper combinations; and a combination scrambler configured to rotate said first gate wheel by first and second different angular increments if said lock-bolt drive mechanism attempts to actuate said lock bolt from said locked position to said unlocked position after entry of successive improper combinations.

2. The combination lock of claim 1 wherein said combination entry device is operatively coupled with said combination scrambler for causing rotation of said first gate wheel during an attempt by said lock-bolt drive mechanism to actuate said lock bolt from said locked position to said unlocked position after entry of one of said plurality of improper combinations.

3. The combination lock of claim 2 wherein said combination entry device is operatively coupled with said lock-bolt drive mechanism for actuating said lock bolt from said locked position to said unlocked position after entry of said proper combination and for attempting to actuate said lock bolt from said locked position to said unlocked position after entry of one of said plurality of improper combinations.

4. The combination lock of claim 1 wherein:

said first gate wheel includes a circumferentially-extending toothed rim; and said combination scrambler includes a first pinion mounted for eccentric rotation about an axis of rotation, said first pinion being configured to be selectively meshed with said toothed rim and to be selectively rotated about said axis of rotation for rotating said first gate wheel to provide said first and second different angular increments.

5. The combination lock of claim 4 wherein said combination entry device is operatively coupled with said combination scrambler for selectively meshing said first pinion with said toothed rim of said first gate wheel during an attempt by said lock-bolt drive mechanism to actuate said lock bolt from said locked position to said unlocked position after entry of one of said plurality of improper combinations.

6. The combination lock of claim 5 wherein said combination entry device is operatively coupled with said combination scrambler for rotating said first pinion to rotate said first gate wheel during an attempt by said lock-bolt drive mechanism to actuate said lock bolt from said locked position to said unlocked position after entry of one of said plurality of improper combinations.

7. The combination lock of claim 4 wherein said combination entry device is operatively coupled with said combination scrambler for rotating said first pinion to rotate said first gate wheel, when said first pinion is meshed with said toothed rim, during an attempt by said lock-bolt drive mechanism to actuate said lock bolt from said locked position to said unlocked position after entry of one of said plurality of improper combinations.

8. The combination lock of claim 4 wherein said combination scrambler further includes a rotatable actuator operative for meshing said first pinion with said toothed rim during an attempt by said lock-bolt drive mechanism to actuate said lock bolt from said locked position to said unlocked position after entry of one of said plurality of improper combinations.

9. The combination lock of claim 8 wherein said combination scrambler further includes a drive pawl mechanically coupling said rotatable actuator with said first pinion.

10. The combination lock of claim 9 further comprising:

a lock case housing said combination scrambler, said lock case including at least one projection, and wherein said rotatable actuator includes at least one inclined ramp configured to engage said a least one projection, said at least one inclined ramp movable relative to said at least one projection to transform rotation of said rotatable actuator into movement of said drive pawl.

11. The combination lock of claim 9 wherein said combination scrambler includes a second pinion mechanically coupling said drive pawl with said first pinion.

12. The combination lock of claim 11 wherein said drive pawl includes a nib engageable with said second pinion for causing rotation of said first pinion as said drive pawl is moved by said rotatable actuator.

13. The combination lock of claim 1 wherein said combination scrambler further includes a rotatable actuator mechanically coupled with said first gate wheel for providing rotation of said first gate wheel during an attempt by said lock-bolt drive mechanism to actuate said lock bolt from said locked position to said unlocked position.

14. The combination lock of claim 13 further comprising:

a lock case housing said combination scrambler, said lock case including at least one projection, and wherein said actuator includes at least one inclined ramp configured to engage said at least one projection, said at least one inclined ramp movable relative to said at least one projection to transform rotation of said rotatable actuator into rotation of said first gate wheel.

15. A combination lock comprising:

a fence;

a combination entry device;

a drive hub operatively coupled with said combination entry device and rotatable about an axis of rotation;

a rotatable tumbler wheel assembly including a first outer wheel, a second outer wheel, and a gate wheel positioned along said axis of rotation between said first and second outer wheels, said gate wheel having a gate configured to be engageable with said fence, said tumbler wheel assembly being rotatable in response to operation of said combination entry device for changing the relative angular alignment between said gate and said fence, and said first and second outer wheels having a coupled condition in which said tumbler wheel assembly is coupled for rotation about said axis of rotation with said drive hub and an uncoupled condition in which said tumbler wheel assembly is uncoupled from said drive hub such that said drive hub is rotatable about said axis of rotation independent of said tumbler wheel assembly;

a lock bolt movable between locked and unlocked positions;

a lock-bolt drive mechanism configured for moving said lock bolt from the locked position to the unlocked condition when said gate is aligned angularly with said fence by operation of said combination entry device; and a combination change key operative for selectively manipulating said first and second outer wheels to provide the coupled and uncoupled conditions.

16. The combination lock of claim 15 wherein said combination change key is configured for selectively rotating said first outer wheel relative to said second outer wheel to provide the coupled and the uncoupled conditions.

17. The combination lock of claim 16 wherein said first outer wheel includes a plurality of spreading elements, and said second outer wheel includes a plurality of first and second spring arms selectively coupling said second outer wheel with said drive hub, each of said spreading elements being positioned between a corresponding pair of said first and second spring aims for providing the coupled condition and being removed from between the corresponding pair of said first and second spring arms for providing the uncoupled condition.

18. The combination lock of claim 17 wherein said spreading elements are wedges.

19. The combination lock of claim 18 wherein each of said wedges has a tapered head, each of said first spring anus includes a free end with an inclined surface, and each of said second spring arms includes a free end with an inclined surface, said inclined surfaces operating to guide said tapered head between the corresponding pair of first and second spring arms as said first and second outer wheels are moved from the uncoupled condition to the coupled condition.

20. The combination lock of claim 15 wherein said combination change key includes a first engagement element configured for holding said first outer wheel stationary, and a second engagement element configured for rotating said second outer wheel relative to said first outer wheel in one direction for providing the uncoupled condition and in an opposite direction for providing the coupled condition.

21. The combination lock of claim 20 wherein said first and second outer wheels each include a toothed outer rim, said first engagement element includes a toothed section configured to mesh with said outer toothed rim of said first outer wheel, and said second engagement element includes a rotatable spur gear configured to mesh with said toothed outer rim of said second outer wheel.

22. The combination lock of claim 21 wherein said drive hub includes an outer peripheral rim and a plurality of teeth arranged about said outer peripheral rim, and said tumbler wheel assembly includes a coupling wheel having an inner peripheral rim and a plurality of teeth arranged about said inner peripheral rim for engaging said plurality of teeth of said drive hub when said first and second outer wheels are in the coupled condition.

23. The combination lock of claim 15 wherein said gate wheel is rotationally symmetrical about said axis of rotation.

24. The combination lock of claim 15 wherein said combination change key is free of features capable of being spatially related with said gate in a radiographic image of said combination lock.

25. A combination lock comprising:

a fence;

a rotatable gate wheel including an outer rim, an axis of rotation, a first projection extending radially outward from said outer rim, and a plurality of second projections extending radially outward from said outer rim, said first projection and said second projections being circumferentially arranged with a spaced relationship about said outer rim, said first projection having a different shape than said second projections, said first projection having a triangular cross-sectional profile in a radial direction relative to said axis of rotation, said first projection and an adjacent one of said second projections defining a first recess shaped to permit engagement by said fence, and adjacent pairs of said second projections defining a plurality of second recesses;

a combination entry device operatively coupled with said gate wheel, said combination entry device capable of rotating said gate wheel about said axis of rotation for changing a relative angular alignment between said first recess and said fence;

a lock bolt movable between locked and unlocked positions; and a lock-bolt drive mechanism configured for moving said lock bolt from the locked position to the unlocked condition when said first recess is aligned with said fence.

26. The combination lock of claim 25 wherein said first projection has a right-triangular cross-sectional profile.

27. The combination lock of claim 25 wherein said gate wheel is rotationally symmetrical about said axis of rotation.

28. The combination lock of claim 25 wherein each of said second projections has a rectangular cross-sectional profile in a radial direction relative to said axis of rotation.

29. The combination lock of claim 25 wherein said fence is inclined with an inclination angle transverse to said axis of rotation so that a portion of said fence contacts a radially-outermost surface of one of said plurality of second projections if said first recess is nor aligned with said fence.

30. The combination lock of claim 25 further comprising:

a combination change key operative for changing a relative angular alignment between said combination entry device and said first recess, said combination change key being free of features capable of being spatially related with said first recess in a radiographic image of said combination lock.

31. A combination lock comprising:

a fence;

a gate wheel assembly including an axis of rotation, a smooth-rimmed center wheel and first and second gate wheels positioned on opposite sides of said center wheel, said first and second gate wheels each including an outer rim, a first projection extending radially outward from said outer rim, and a plurality of second projections extending radially outward from said outer rim, said first projection and said second projections being circumferentially arranged with a spaced relationship about said outer rim of each of said first and second gate wheels, said first projection and an adjacent one of said second projections on each of said first and second gaze wheels defining a corresponding one of a pair of recesses each shaped to permit engagement by said fence, said center wheel having a greater radial dimension relative to said axis of rotation than a radially-outermost surface of said first and said second projections, and said center wheel guiding said fence for engaging said recesses;

a combination entry device operatively coupled with said gate wheel assembly, said combination entry device capable of rotating said gate wheel assembly about said axis of rotation for changing a relative angular alignment between said recesses and said fence;

a lock bolt movable between locked and unlocked positions; and a lock-bolt drive mechanism configured for moving said lock bolt from the locked position to the unlocked condition when said recesses are aligned with said fence.

32. The combination lock of claim 31 wherein each of said first projections has a triangular cross-sectional profile in a radial direction relative to said axis of rotation.

33. The combination lock of claim 32 wherein each of said first projections has a right-triangular cross-sectional profile.

34. The combination lock of claim 31 wherein said first and second gate wheels are rotationally symmetrical about said axis of rotation.

35. The combination lock of claim 31 wherein each of said second projections has a rectangular cross-sectional profile in a radial direction relative to said axis of rotation.

36. The combination lock of claim 31 wherein said fence includes a pair of prongs inclined with an inclination angle transverse to said axis of rotation so that a portion of each of said prongs contacts said radially-outermost surface of one of said plurality of second projections if said recesses are not aligned angularly with said fence.

37. The combination lock of claim 31 further comprising a combination change key operative for changing a relative angular alignment between said combination entry device and said recesses, said combination change key being free of features capable of being spatially related with said recesses in a radiographic image of said combination lock.

38. The combination lock of claim 31 wherein said recess of said first gate wheel is positioned with an angular relationship relative to said recess of said second gate wheel.

39. The combination lock of claim 38 wherein said fence includes a pair of prongs inclined with an inclination angle transverse to said axis of rotation of said first and second gate wheels, said prongs having a spacing in the axial direction to receive therebetween a portion of said center wheel.

40. The combination lock of claim 31 wherein said recess of said first gate wheel is positioned with an angular relationship relative to said recess of said second gate wheel.

41. The combination lock of claim 40 wherein said fence includes a pair of prongs inclined with an inclination angle transverse to said axis of rotation of said first and second gate wheels, said prongs having a spacing in the axial direction to receive therebetween a portion of said center wheel.

42. A method of preventing surreptitious compromise of a mechanical combination lock, comprising:

entering a first combination number that rotates a first gate wheel to a first angular orientation;

entering at least a second combination number that rotates at least a second gate wheel to a second angular orientation relative to the first angular orientation of the first gate wheel;

attempting in a first attempt to open the mechanical combination lock;

rotating the first gate wheel by a first angular increment from the first angular orientation as the first attempt is made to open the mechanical combination lock;

entering at least a third combination number that rotates at least a second gate wheel to a third angular orientation relative to the first angular orientation of the first gate wheel;

attempting in a second attempt to open the mechanical combination lock; and rotating the first gate wheel by a second angular increment different from the first angular increment as the second attempt is made to open the mechanical combination lock.

43. The method of claim 42 wherein said first angular increment is larger than said second angular increment.

44. The method of claim 42 wherein said first angular increment is smaller than said second angular increment.

* * * * *

UNITED STATES PATENT AND TRADEMARK OFFICE

CERTIFICATE OF CORRECTION

PATENT NO. : 6,904,778 B2
APPLICATION NO. : 10/424885
DATED : June 14, 2005
INVENTOR(S) : Jasper It is certified that error appears in the above-identified patent and that said Letters Patent is hereby corrected as shown below:

IN THE SPECIFICATION:

Column 4, line 8, change the word "or" to --of--.
Column 4, line 30, change "FIGS." to --FIG.--.
Column 8, line 41, change the word "properly" to --proper--.
Column 9, line 34, after the word "are", remove the word "an".
Column 9, line 59, change the number "53" to --52--.
Column 11, line 37 change the word "enter" to --entered--.
Column 12, line 26 change the word "fo" to --of--.
Column 14, line 29 change the word "wheels" to --wheel--.
Column 16, line 50 change the word "a" to --at--.
Column 17, line 57 change the word "anus" to --arms--.
Column 18, line 67 change the word "nor" to --not--.
Column 19, line 22 change the word "gaze" to --gate--.
Column 20, line 13 after the word "of" insert --recess-engaging--.
Column 20, lines 18-26, delete claims 40 and 41.
Column 20, line 27 change "42" to --40--.
Column 20, line 41 change "a" to --the--.
Column 20, line 50, change "43" to --41--.
Column 20, line 50 change "42" to --40--.
Column 20, line 52 change "44" to --42--.
Column 20, line 52 change "42" to --40--.

Signed and Sealed this

Tenth Day of April, 2007

JON W. DUDAS
*Director of the United States Patent and Trademark Office*